United States Patent [19]

Baxter

[11] 3,963,852

[45] June 15, 1976

[54] CLAY-COATED RECORD MATERIAL OF IMPROVED IMAGE DURABILITY

[75] Inventor: George Baxter, Font Hill, Canada

[73] Assignee: Moore Business Forms, Inc., Niagara Falls, N.Y.

[22] Filed: Mar. 6, 1975

[21] Appl. No.: 555,742

Related U.S. Application Data

[63] Continuation of Ser. No. 357,261, Aug. 4, 1973, abandoned, which is a continuation-in-part of Ser. No. 125,075, March 17, 1971, abandoned.

[52] U.S. Cl. ..... 428/325; 282/27.5; 427/145; 427/146; 427/150; 428/341; 428/454

[51] Int. Cl.[2] ..... B41M 5/00; B41M 5/12

[58] Field of Search ..... 427/146, 145; 428/323, 428/454, 488, 325, 341; 282/27.5

[56] References Cited

UNITED STATES PATENTS

| | | | |
|---|---|---|---|
| 3,293,060 | 12/1966 | Harbort | 282/27.5 |
| 3,326,705 | 6/1967 | Duke | 106/72 |
| 3,330,722 | 7/1967 | Amano et al. | 162/181 |
| 3,389,009 | 6/1969 | Oda et al. | 428/307 |
| 3,622,364 | 11/1971 | Sugahara | 106/72 X |

FOREIGN PATENTS OR APPLICATIONS

| | | |
|---|---|---|
| 41-2373 | 2/1966 | Japan |
| 41-7622 | 4/1966 | Japan |
| 41-16262 | 9/1966 | Japan |
| 42-8811 | 4/1967 | Japan |

OTHER PUBLICATIONS

Weil–Malherbe et al., "J. Chem. Soc. of London," Dec. 1948, Part II, pp. 2164–2169.

*Primary Examiner*—Thomas J. Herbert, Jr.

[57] ABSTRACT

Record material useful for carbonless copying systems and the like and adapted to develop distinctive coloration on contact with a preferably colorless dye precursor reactive in an electron donor-acceptor color-producing mechanism, characterized by a thin, uniform surface coating containing smectite clay having its molecular structure chemically modified to impart substantially Newtonian viscosity behavior to aqueous suspensions thereof. On examination by X-ray diffraction, the chemically modified clay preferably exhibits a discernible peak at a characteristic angle of diffraction. Chemical modification is preferably achieved by contacting the clay with the acid, such as sulfuric acid, for a time sufficient to irreversibly alter the clay structure. Such clay coatings can be applied by the usual coating techniques and produce dye images of substantially improved resistance to fading by light and ordinary atmosphere.

26 Claims, 16 Drawing Figures

VISCOSITY BEHAVIOR OF MIXTURES OF KAOLIN & TREATED & UNTREATED SMECTITE CLAYS

X-RAY DIFFRACTION DATA OF UNTREATED VARIOUSLY TREATED MONTMORILLONITE SMECTITE CLAY WITH ADSORBED ETHYLENE GLYCOL

X-RAY DIFFRACTION DATA OF SMECTITE CLAY (BATES HOLE) ALONE & WITH ADSORBED DYE PRECURSOR

X-RAY DIFFRACTION DATA SHOWING LOSS OF MONTMORILLONITE CLAY STRUCTURE WITH INCREASED TIME OF ACID LEACHING OF BATES HOLE BY MEANS OF ADSORBED BENZYL ETHER OF MICHLER'S HYDROL

FADING CHARACTERISTICS OF DYE IMAGES WITH TREATED SMECTITE CLAY VERSUS PRIOR ART CLAYS - LABORATORY EXPOSURE

FADING CHARACTERISTICS OF DYE IMAGES WITH TREATED SMECTITE CLAY VERSUS ATTAPULGITE-DAYLIGHT EXPOSURE

FADING CHARACTERISTICS OF DYE IMAGE WITH UNTREATED & VARIOUSLY TREATED SMECTITE CLAY BATES HOLE

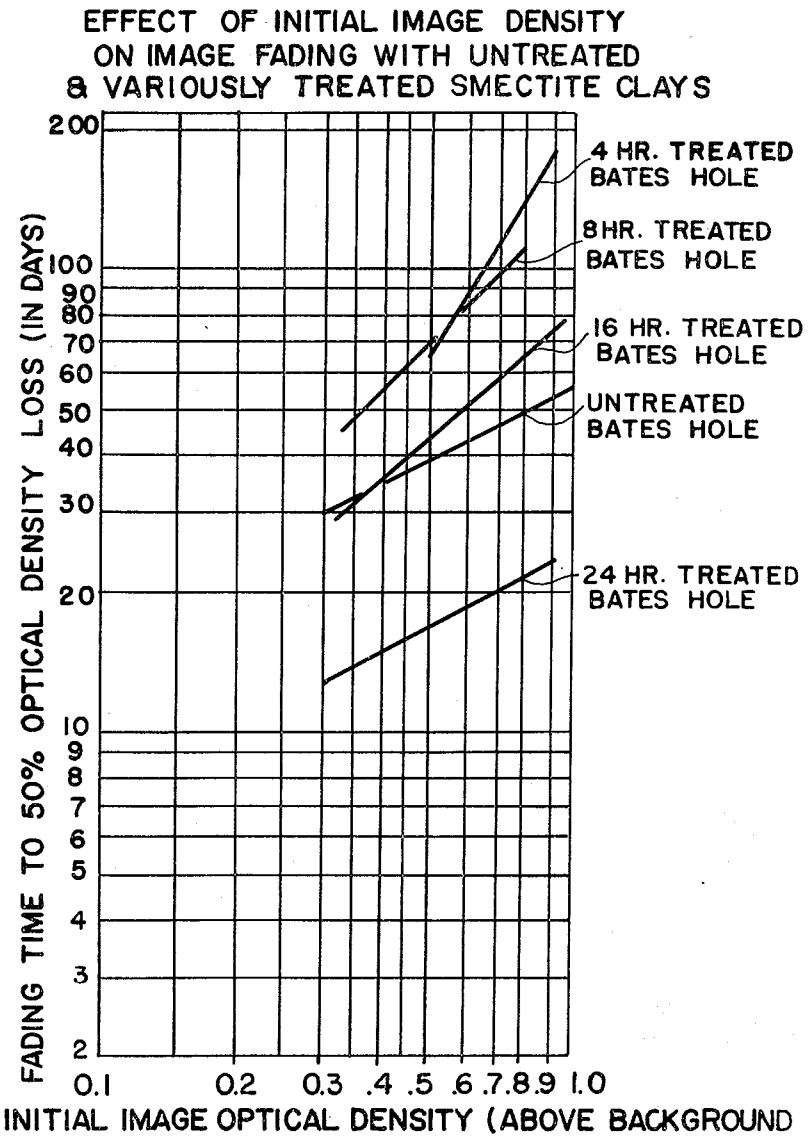
EFFECT OF INITIAL IMAGE DENSITY
ON IMAGE FADING WITH UNTREATED
& VARIOUSLY TREATED SMECTITE CLAYS
4 HR. TREATED BATES HOLE
8 HR. TREATED BATES HOLE
16 HR. TREATED BATES HOLE
UNTREATED BATES HOLE
24 HR. TREATED BATES HOLE
FADING TIME TO 50% OPTICAL DENSITY LOSS (IN DAYS)
200
100
90
80
70
60
50
40
30
20
10
9
8
7
6
5
4
3
2
0.1
0.2
0.3
.4
.5
.6
.7
.8
.9
1.0
INITIAL IMAGE OPTICAL DENSITY (ABOVE BACKGROUND

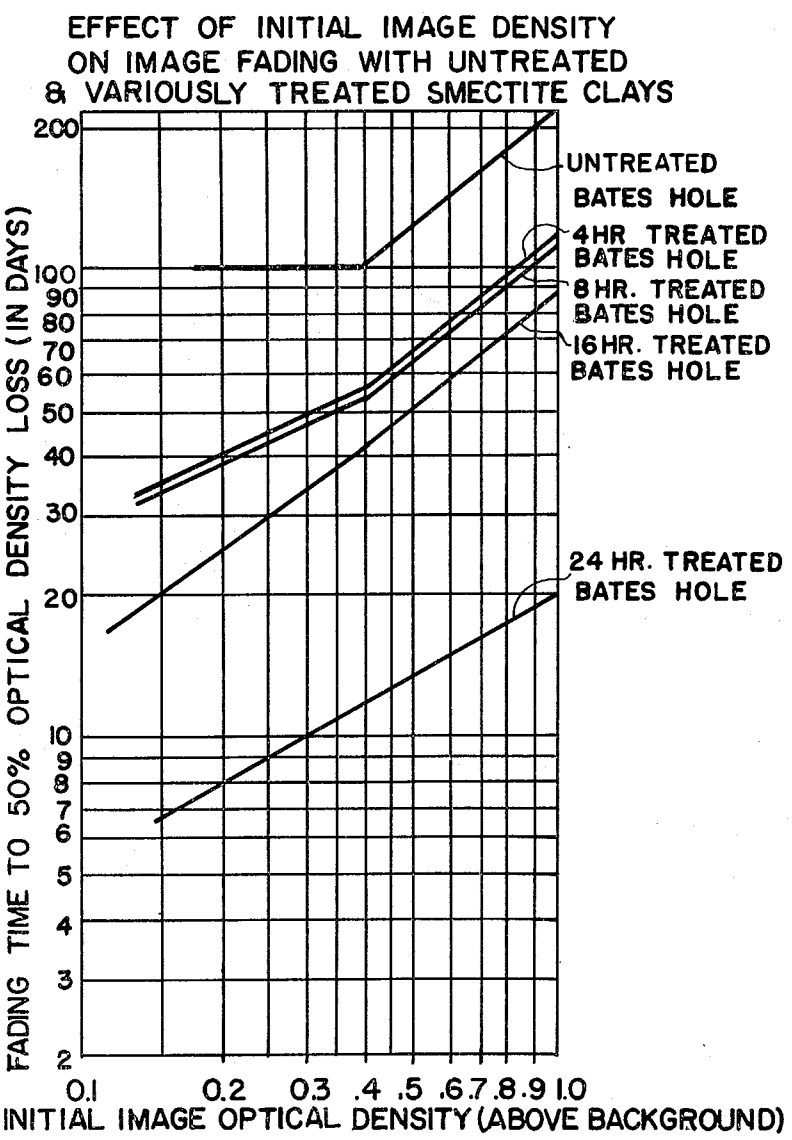
EFFECT OF INITIAL IMAGE DENSITY
ON IMAGE FADING WITH UNTREATED
& VARIOUSLY TREATED SMECTITE CLAYS
UNTREATED BATES HOLE
4 HR. TREATED BATES HOLE
8 HR. TREATED BATES HOLE
16 HR. TREATED BATES HOLE
24 HR. TREATED BATES HOLE
FADING TIME TO 50% OPTICAL DENSITY LOSS (IN DAYS)
200
100
90
80
70
60
50
40
30
20
10
9
8
7
6
5
4
3
2
0.1
0.2
0.3
.4
.5
.6
.7
.8
.9
1.0
INITIAL IMAGE OPTICAL DENSITY (ABOVE BACKGROUND)

EFFECT OF INITIAL IMAGE DENSITY ON IMAGE FADING WITH UNTREATED & VARIOUSLY TREATED SMECTITE CLAYS

EFFECT OF INITIAL IMAGE DENSITY ON IMAGE FADING WITH UNTREATED & VARIOUSLY TREATED SMECTITE CLAYS

CLAY-COATED RECORD MATERIAL OF IMPROVED IMAGE DURABILITY

This is a continuation of co-pending application Ser. No. 357,261, filed Aug. 4, 1973, now abandoned, which in turn is a continuation-in-part of application Ser. No. 125,075, filed Mar. 17, 1971, now abandoned.

BACKGROUND OF THE INVENTION

1. Field of the Invention

This invention relates to record material for receiving image-wise information and is concerned more specifically with a clay-coated record material capable of forming colored images of improved durability or performance, particularly with respect to fading with exposure to light and/or ordinary atmosphere. The record material of this invention is especially formulated for use in the so-called carbonless copying or colorless "carbon paper" systems in conjunction with one of a well-known group of colorless dye-forming compounds or precursors, which cooperates with the clay-coating on the record material to produce on contact a distinct color in accordance with an electron donor-acceptor reaction mechanism which is per se well known in the art. The present record material can serve as the image-receiving sheet part of a pressure-sensitive set, in association with a transfer sheet carrying in some pressure-releasable form, e.g., within pressure-rupturable microcapsules coated thereon, the colorless dye precursor or can be used in the form of a self-contained or so-called "couplet" sheet in which the clay coating is provided on a common face of a sheet support with a colorless dye precursor in some temporarily isolated, pressre-releasable condition.

2. Description of the Prior Art

In recent years carbonless copying or colorless carbon paper systems have come into wide-spread usage for business records, print-out paper for computers and so on, and a very considerable bulk of patent literature pertaining to the preparation of such materials has grown up starting from two early series of patents U.S. Pat. Nos. 2,505,470 –489; 2,548,366–366; and 2,550,467–473. All of these patents in general disclose pressure-sensitive record material utilizing in various physical associations or arrangements a color-forming dye precursor compound, preferably colorless, selected from one of a number of chemical classes and contained in some kind of pressure-rupturable or -releasable state, in conjunction with an image-developing sheet carrying solid particles of a material reacting with the dye precursor to produce a visibly colored reaction product, such as kaolin, attapulgite and other comparable clays. The dye precursor and the reactive clay form the components of an electron donor-acceptor surface absorption chemical reaction, resulting on contact in a distinctively colored reaction product.

From the beginning, colorless copying systems operating on the basis of this donor-acceptor mechanism have been plagued with loss of coloration of the developed dye image with exposure to light and ordinary atmosphere. Such image deterioration could certainly be avoided if all office records could be maintained under high vacuum, but this is not a practical approach except in most exceptional circumstances and would be expensive and inconvenient at best. More durable images could undoubtedly be obtained by the image-wise transfer of inert pigments, such has carbon black, contained in some pressure-releasable structure. The paramount objective of a colorless or carbonless copying system, however, ruled out the possibility of using such a pigment, since the pressure-transferable surface of the resultant material would necessarily have essentially the appearance of conventional carbon paper which was aesthetically objectionable. Any system obtaining a colored image by the chemical reaction of uncolored or differently colored reactant components is inherently susceptible to color fading or deterioration by light and atmosphere and improvement in the useful like of such images is perhaps the most important single desideratum in this art.

One expedient adopted by the leading developer of colorless carbon paper systems involved judicious combination of plural dye precursor compounds, including a relatively fast reacting but relatively fugitive primary color-forming precursor compound in association with a secondary color-forming compound converting from colorless to colored state over prolonger periods of time and optimally under essentially the same conditions that accelerated the fading of the primary color-forming precursor. For example, a triphenylmethane precursor such as Crystal Violet Lactine might be combined with a leuco compound such as leuco methylene blue. Indeed, most of the patents identified above, e.g., U.S. Pat. No. 2,505,470, recognized even at that early date the desirability of aggregating two or more precursor compounds behaving in such a manner during color formation as to compensate for the inadequacies of one another. While this approach to solving the problem was an improvement, it obviously could not be considered an ideal answer. It required the provision of a full image-forming amount of each of the plural precursors, adding to the complexity and cost of the system, especially where the volume of the sheet material being produced was large, and necessitated the careful selection of precursors to achieve a compatible combination with appropriately balanced fading characteristics so that the image did not at any time pass through an essentially colorless stage. In addition, the color of the image tending to change in time, which was often disconcerting to the average user, and the range of colors that could be conveniently made available was quite limited.

In recognition of the limitations implicit in the just described approach, it has been more recently modified by adding an acidic polymeric material, particularly a phenolic resin, to the image-developing coating on the record material to react with the dye precursor rather than the clay. Such a modified system is disclosed in Canadian Patent No. 768,039 issued Sept. 26, 1967, and in British Patent No. 1,090,866 published Nov. 15, 1967, among others. While the acidic polymeric material was allegedly superior to the previous system in reducing the susceptibility of the record material to desensitization before use by exposure to ambient conditions, even in this improved system a combination of substantially oppositely behaving colorless dye precursor compounds is preferably employed. In further improvements along the lines of the acidic polymer coated record material, as in U.S. Pat. No. 3,427,180, for example, the importance from a practical standpoint of combining a rapidly developing high-fading color precursor with a slow developing secondary color precursor is still strongly emphasized. Moreover, the addition of the polymer was more costly than the clay alone, especially since some clay was included nevertheless for appearance sake, and the feel of the modified record was unnatural compared to regular paper. Obviously, therefore, the several approaches embodied in existing commercial systems do not constitute a fundamental advance in the art in overcoming or at least significantly retarding the fading of color images produced on record material by means of an electron donor-acceptor solid surface color-forming reaction mechanism.

In accordance with the present invention, a bentonite-type clay chemically modified so as to favorably influence its rheological characteristics is used as the active electron receiving-color-forming component carried on the face of a record material adapted to form an image thereon by means of the electron donor-acceptor mechanism previously referred to. The research underlying this invention has established that a bentonite-type clay is uniquely equipped in principle to serve as an electron receptor in this mechanism but is subject to the practical obstacle that a clay of this type has in the past been impossible to coat as an aqueous composition under conditions necessary for commercial production. Virtually all literature concerned with such clays record their property of solidifying at rest into a gel when mixed with water at concentrations of about 5–10% and above. Such gels are thixotropic, becoming flowable when subjected to shearing or agitating forces, and returning to the gel state promptly on removal of these forces.

Thixotropy is a desirable property for certain utilities for bentonite, among the more prominant of which is as a drilling mud for oil well drilling, but it is an insurmountable impediment to coating the material as a thin layer on a suiable record material support, nominally paper. Even if the large amounts of mechanical energy necessary to place the thixotropic gel in flowable condition were available, it would be impossible by any conventional commercial coating device, whether using an air knife, a coating blade, a coating roller or otherwise, to apply an acceptable coated layer of such a gel. Immediately on leaving the coating instrumentality, i.e., the blade or the air knife, the composition returns to its gel state, preventing the occurrence of a leveling or flowing action that is essential to produce a thin uniformly flat layer free of channelling, striations and other objectionably appearing surface effects. Even if the coating step is followed by a calendering operation, as is frequently the case, the quality of coating needed for commercial acceptance could not be achieved. Moreover, clay coating compositions for sheet material require clay concentrations substantially greater than 10% for economically feasible manufacture, in the order of at least about 20% of clay solids to avoid excessive absorption of water by the paper, causing cockling and drying problems. Ordinarily, concentrations higher even than 20% are considered desirable to reduce to as low a level as possible the amount of water that must be subsequently evaporated in order to achieve a dry coated sheet material. The power requirements to fluidize, even momentarily, an aqueous bentonite composition containing 20% or more of clay solids would be rediculously prohibitive.

The coating of paper with ordinary clays is commonplace in the art and, in fact, the paper industry is the largest consumer of kaolinite clays. It is known in this industry to adjust the rheological properties of the coating suspension or "color" by means of so-called peptizing agents, such as inorganic salts, e.g., NaCl, and the polyphosphates, alkalis, e.g., NaOH, or organic compounds, e.g., tannin and the phenolates. Such agents are not suitable for this invention, however, since at influential levels of concentration, they desensitize the clay against reaction with the dye precursor and apparently actually compete with the precursor for reaction sites on the clay molecules.

A number of patents in the field of this invention include bentonite in lists of acidic reacting clays useful in the practice of the respective contributions thereof, starting from the early U.S. Pat. No. 2,505,470 and extending through a number of more recent U.S. patents including U.S. Pat. Nos. 3,330,722, 3,389,007, 3,455,721, 3,516,845 and British patent No. 1,082,293 to mention a few. None of these patents even purport to acknowledge the over-whelming rheological considerations involved in the successful coating of bentonite clay compositions, or to discuss this type of clay except in the context of a general disclosure of equivalents and it is no accident that all of the working examples that can be found in the patents in this field which do not mention bentonite call for the use of other types of clays, typically kaolin or attapulgite. Clearly, the inventors of these patents made no attempt to deal constructively with the difficulties inherent in the handling of bentonite compositions for sheet coating purposes and, consequently, throw no light whatever on the actual practical use of this particular type of clay mineral.

BRIEF DESCRIPTION OF THE DRAWINGS

In order to provide visual demonstration of the improved results obtainable in accordance with the present invention, as well as a comparison of the behavior of the chemically modified clay of the invention in relation to other clays conventionally used in the prior art, a number of graphs are reproduced in the drawings accompanying this application which should be considered in conjunction with the following detailed description. A brief description of the specific purpose of each of these plots is as follows:

FIG. 13 is a characteristic fading curve showing the effect of varying concentration of dye precursor compound on the fading rate of images obtained therefrom with unmodified and variously chemically modified bentonite clays;

FIG. 14 is a characteristic fading curve similar to FIG. 13 and additionally illustrating the effect of exposure to humidity of the clays on the subsequent formation of images obtained using the same precursor and clays as in FIG. 13;

SUMMARY OF THE INVENTION

Figure 2:
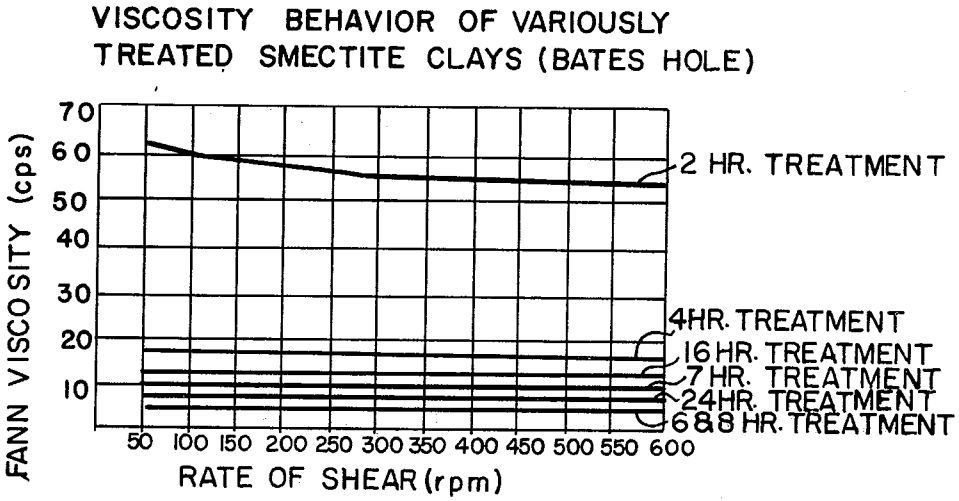
FIG. 2 is a similar plot for one of the clays of FIG. 1 measured at a concentration level of 27% solids, the data for the unmodified natural clay being absent because it was impossible to obtain.

In accordance with the invention, record material for receiving images especially for use in carbonless copying systems and which is adapted to form colored images by means of an electron donor-acceptor color-forming reaction with conventional dye precursors is obtained by coating paper or any other conventional sheet support with a smectite clay which is chemically modified so as to significantly alter its rheological properties, the extent of such modification being sufficient to impart substantially Newtonian viscosity characteristics to an aqueous suspension of such claya. Included within the class of "smectite clays" is any clay high in Montmorillonite clay mineral content, such as bentonite clays, Montmorillonite clay mineral per se derived from bentonite clays, as well as mixtures of Montmorillonite clay mineral or bentonite clay with other natural clays such as kaolin. One suitable chemical modification is achieved by treating the smectite clay with an inorganic acid in the manner conventionally practiced in activating such clays for use in the oil and wax industries, especially for bleaching or decolorizing oils, and in enhancing the catalytic properties thereof for hydrocarbon refining and conversion. Complete chemical modification by such acid treatment is preferably avoided in order that the characteristic molecular layer structure of the Montmorillonite clay mineral component is not totally destroyed.

Colorless dye precursors of the kinds conventionally employed in colorless carbon paper systems form, when absorbed on record material coated with the chemically modified smectite clays of the invention, color images exhibiting a substantially reduced fading rate when exposed to light and atmosphere and correspondingly increased color durability without detriment to their normal rapid rate of color development. As a consequence of the greatly reduced susceptibility to fading, durable record copies can be obtained with a single dye precursor, which would be otherwise considered fugitive by previous standards in this art, without the necessity for inclusion of a secondary or supplementary precursor of the slow-developing type. Intense coloration develops with such precursors and the chemically modified clays of the invention essentially instantaneously on contact and the high initial density of the colored image makes possible the use of minimum levels of the precursor, as well as of the amount of coating applied to the record material support. The chemically modified clays of the invention have viscosity characteristics that are entirely compatible with conventional high-speed sheet coating equipment and can be processed by such equipment at all of the usual levels of solids concentration in the coating suspension, even as high as 40% solids or above. The record materials of the invention do not require special protective packaging or storage conditions prior to use even when coated at minimum weights by virtue of their high stability to ambient atmospheric conditions, including high humidity. If necessary, the coating compositions of the invention can tolerate minute proportions of additives conventionally employed as dispersion assistants for clay suspensions. The chemically modified clays make possible the formulation of systems free of ecologically undesirable ingredients that have been required by prior commercial systems and offering the possibility of supplanting to a much greater extent than heretofore possible ordinary carbon paper which is an increasingly serious source of ecological contamination.

GENERAL DESCRIPTION OF THE INVENTION

The Clay Material

During the course of the preceding introduction, except in the "Summary," the clays forming the basic starting material of this invention were referred to under the name "bentonite" since this description was mainly directed to an evaluation of the prior art and bentonite is the name commonly applied by the prior art to this material. According to modern nomenclature in the clay field, bentonite is considered to be the "rock" name and has been replaced by the group name of smectite clays (see Grim, *Clay Mineralogy*, 2nd Edition, McGraw Hill Book Co., page 77) and this more apt terminology will be followed through the remainder of this disclosure. A smectite clay is characterized by a significant content of the clay mineral Montmorillonite in the amount normally of at least about 15–20%, and more often 50%, up to approximately 100% in rare instances, and it is the Montmorillonite that serves as the active constituent of the clays useful in accordance with the present invention. The structure of Montmorillonite clay mineral is now well defined and is recognized as consisting of a lattice composed of basic three-layer units in which a central alumina octahedral sheet separates two silica tetrahedral sheets with the tips of the tetrahedrals of the latter being mutually facing and combined with the exterior layers of the alumina sheet so as to form a common layer of oxygen atoms. The layers in these units are considered to extend continuously in their plane direction and are arranged in stacked relation in the perpendicular or so-called c-axis direction. The lattice formed by the assembly of these three-layer units has the capacity of expanding in the c-axis direction, varying the separation between adjacent units and it is this expanding lattice phenomenon that uniquely adapts the smectite clays for purposes of the present invention.

The clay mineral Montmorillonite" can be separated by flotation from the other earthy components with which it occurs in nature to form the smectite clays and, as used herein, "Montmorillonite clay mineral" designates the pure mineral thus separated. This montmorillonite mineral can be used as the clay component of the invention and, in fact, is the preferred clay material here. Such separation is not of critical importance to the practice of the invention, however, and the natural smectites can serve as the basic material for the practice of the invention, particularly where their content of Montmorillonite clay mineral is reasonably high, say in the order of 50% or more. In addition to naturally occurring mixtures of Montmorillonite clay mineral with other earthy components, similar mixtures produced artificially have been found to serve substantially equally well the needs of this invention. Thus, Montmorillonite clay mineral or a smectite clay high in Montmorillonite mineral content can be mixed with any of the other common clays compatible therewith, such as kaolin, or attapulgite even when added in major proportions up to say about 80% in weight.

As employed herein, the term smectite clay is intended to designate Montmorillonite clay mineral in its substantially pure form, as well as mixtures of significant proportions of about 15–20% by weight of Montmorillonite clay mineral with other common clays or earthy materials whether such mixtures occur naturally or are produced artificially.

The smectite clays to be referred to in the present description are all available commercially and originate from various bentonite deposits scattered throughout the United States. For convenience, they are referred to throughout by their deposit name and the following tabulation will serve to correlate such designations with the actual geographical location of the deposit.

| Clay Designation | Location of Clay Deposit |
|---|---|
| Bates Hole | Bates Hole Deposit, Casper, Wyoming |
| Clark | Clark Deposit, Gonzales Co., Texas |
| Syler | Syler Deposit, Fayette Co., Texas |
| Montmorillonite | Clay mineral extracted from Bentonite from Bates Park Deposit, Casper, Wy. |

Insofar as can be determined, any smectite clay within the general definition set forth above is suitable as the basic clay material for use in accordance with the present invention, irrespective of the location of the mineral deposit from which it may have been mined. Contrary to the experience with the use of various bentonites for other purposes as in the preparation of drilling muds and media for decolorizing oils and the like, the nature of the so-called exchangeable cation present on the Montmorillonite structure unit appears to be independent of the suitability of the clay for the needs of this invention. Consequently, such exchangeable cation can be $Ca^{++}$, $Na^{+}$, $Mg^{++}$and so on, subject only to the restriction that the clay is not too highly colored to suit the requirements of the particular end use contemplated. Other members of the smectite clay group which are considered to be substantially equivalent to Montmorillonite in terms of suitability to the needs of this invention include the following: beidellite, nontronite, hectorite, saponite, and sauconite. Bentonite is the preferred starting clay material by reason of its much more ready availabilty than the other members of the smectite group identified above.

CHEMICAL MODIFICATION OF CLAY

As mentioned earlier, the smectite clays in their raw commercial state on admixture with water develop viscosity characteristics that make them entirely unsuitable for use in any coating operation and it is necessary to this invention that the raw smectite clay be chemically modified in such a way as to alter those characteristics. Not only is the level of the viscosity considerably reduced, but, more importantly, the thixotropic nature of these clays, i.e., their property of setting up into a non-flowable gel in the absence of mechanical shearing forces applied thereto, is substantially completely eliminated, producing a clay which in admixture with water exhibits substantially constant viscosity independently of shearing force. This substantially constant viscosity behavior is referred to herein as "Newtonian viscosity."

While various chemical treatments are conceivable to accomplish this result, one specific preparatory process that has been employed with good results and is preferred is an acid treatment, sometimes referred to as acid-leaching, that has been previously used in activating bentonite clays and the like for use as catalysts i.e., cracking catalysts, in the refining of petroleum hydrocarbons to make gasoline or in enhancing the adsorption characteristics of the clay for decolorizing various oils. Acid treatments for activating bentonite clays and the like for such purposes have been well known in the chemical art for a number of years and are described at numerous places in the literature, for example, U.S. Pat. No. 2,468,127 granted Mar. 8, 1949, U.S. Pat. No. 2,470,872 granted May 24, 1949, and U.S. Pat. No. 2,489,332 granted Nov. 29, 1949. Such treatments ordinarily involve contacting the clay to be treated, preferably under agitation, with a solution of an acid which is normally an inorganic acid, although certain organic acids have been suggested as usable in some cases, the most typical acids being sulfuric acid and hydrochloric acid. As the art is well aware, hydrofluoric acid is not useful because of its highly destructive action on silica-containing materials. The concentration of the acid solution, as well as the temperature, are subject to rather wide variation and the usual range of concentration is from about 5 to about 35% by weight and more frequently about 8 to about 20% by weight, the total amount of the acid relative to the clay on a dry basis being in the range of about 20–100 % with a 30–60% being a common level. Temperatures in the order of 180°–212°F are ordinarily maintained, although lower temperatures could be substituted with appropriate extension of the treatment time. The time of the treatment can be regulated as desired and for a given clay with the other treatment conditions being maintained constant, the length of the time of treatment will control the extent of the chemical modification of the clay structure.

In the present discussion, the treatment time for the clay (expressed in hours) is specified in order to give an approximate indication of the extent of the attack on the clay structure. Such indication cannot be taken as absolute criterion, however, since the composition of the natural smectite clays varies widely from deposit to deposit so that different clays will respond to the same period of treatment to different degrees. Nevertheless, for a given clay chemically modified in a given procedure, the periods of treatment can be taken as a qualitative measure of the effect of the treatment on the clay.

For the experiments included in this description, the several clays as identified were acid treated by contact with sulfuric acid dissolved in water to give a concentration of 20% by weight in an amount sufficient to give a dry weight ratio of acid to clay of 1:1. The mixture was maintained under mild agitation at a temperature of 90°–100°C for the indicated periods of time.

After separation of the treated clay from the treatment solution, there tends to remain in the clay a residual amount of the acid and acid salts. The color development reaction of the particular precursors of this invention is, in principle, independent of acidity and will occur with completely neutralized clay as well as with clay retaining some acidity. Too much residual acidity, however, may be detrimental in increasing the sensitivity of the developed dye image and/or the clay itself to discoloration or other undesirable changes and, preferably, the residual acidity of the clay is reduced to a rather low level by reslurrying the filtered clay with hot water and filtering again, these steps being repeated, e.g., for 2–3 times, until the wash water reaches a constant pH. A typical useful pH is about pH 4 but this is not critical. The level of residual acidity in the clay can be tested by boiling five grams clay in 100 mls distilled water for 30 minutes, filtering and titrating with aqueous potassium hydroxide to alkalinity using an appropriate indicator. Expressed in terms of the number of miligrams of base required, the maximum preferred acidity is not more than about 1.5 mg.KOH/5 gms clay and optimally up to about 1.0 mg. The expense of further washing steps will need to be balanced against the possible effect of a given level of residual acidity in deciding how much acidity could be tolerated in practice in a given case. Reduction of the acidity below about 0.5 mg.KOH/5 gms clay ordinarily be too expensive for the minimal added benefit, if any, it affords.

One effect of the acid treatment just described is to reduce the alumina content in the clay by dissolving the alumina to a more or less degree. Chemical analytical data confirm a reduction in the Al/Si ratio and an increase in the hydrated silica value for the treated versus the untreated clay. A minimum degree of acid treatment for present purposes should bring about an increase in the hydrated silica value in the order of about 2–3%.

One can theorize that the alumina content of the clay tends to enhance its hydrophilic character so that as more and more of the alumina content is extracted by the acid attack, the relatively greater hydrophobic nature of the silica layers of the clay structure comes into play, increasing the overall affinity of the clay structure in the hydrophobic direction. As a consequence, the absorptivity of the clay for hydrophilic media such as water is reduced and thus, when the clay is mixed with water, the extent the clay swells by absorbing the water is likewise reduced and therefore the clay tends to be less thixotropic. Contrariwise, the dye precursors contemplated here are characteristically soluble in organic non-polar solvents which tend to have a greater affinity for the treated clay due to its relatively greater hydrophobic property. Hence, it appears that the acid treatment of the clay works to advantage in two directions, reducing the absorptivity of the clay for polar, hydrophilic media such as water and, consequently, the ultimate thixotropic property of the clay, while enhancing the affinity of the clay for the non-polar solution of the dye precursor.

It is necessary to the acceptable practice of this invention that the clay undergo some permanent degradation by the acid treatment. So-called "acid washes" are known where the clay is flushed with a dilute acid solution in order to elevate the level of acidity in the clay to replace the exchangeable cation with hydrogen and thus increase its reactivity for certain purposes. When an acid washed clay is freed of any residual acidity by the subsequent water washings mentioned above, the effect of the acid wash is neutralized and the clay returns to its original raw state for all intents and purposes. This being the case, an acid wash does not qualify as an acid treatment as the latter term is employed here inasmuch as an acid wash produces no permanent change in the properties of the clay, especially as regards thixotropy and affinity for non-polar media.

The acid treatment contemplated herein has other beneficial consequences than those so far described. It tends to convert to soluble salts any ferric atoms often present in the clay as an impurity and as these atoms are usually the cause of any off-color in the clay, their removal gives a better colored clay. Also, as will be demonstrated later, the modification of the clay molecular structure increases the affinity of the clay for the dye precursor and thus makes possible the adsorption of greater amounts of precursor by a given amount of clay.

DETAILED DESCRITPION OF FIGS. 1–4 REGARDING CLAY VISCOSITY PROPERTIES

Figure 1:
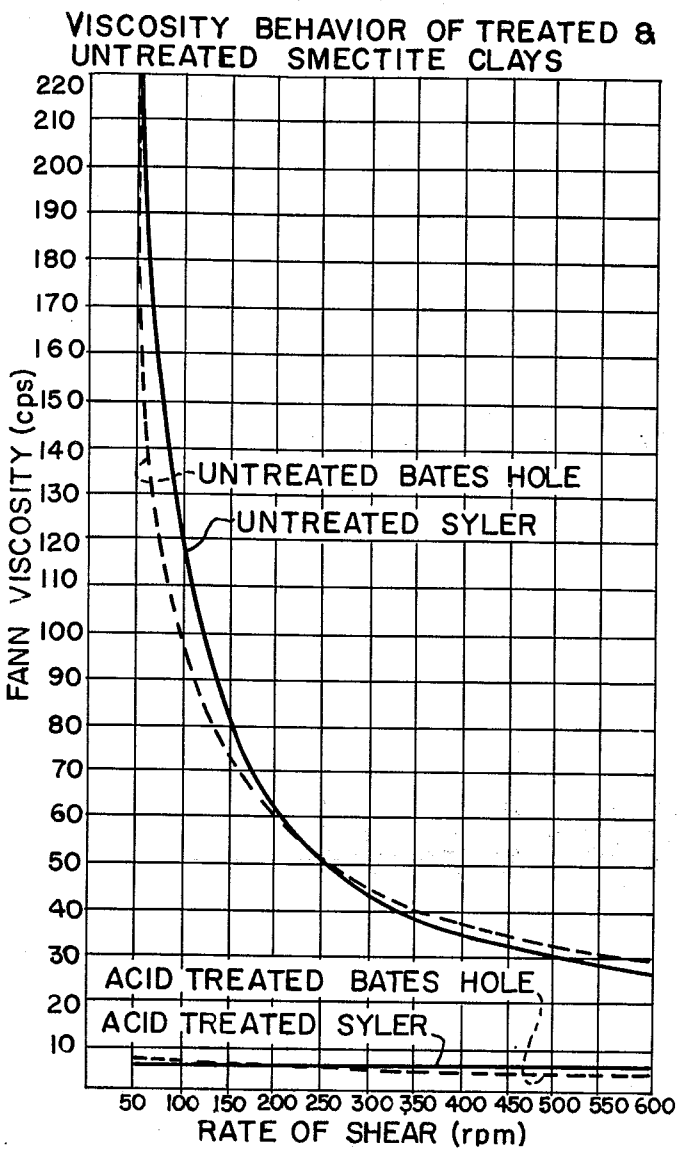
FIG. 1 illustrates the comparative thixotropic properties of two bentonite clays in their natural state and after chemical modification in accordance with the invention, measured at a concentration of 14% clay solids.

In order to demonstrate quantitatively the effect on clay viscosity of the chemical modification contemplated by this invention, FIG. 1 is a graph of the results of viscosity tests carried out on a Bates Hole clay and a Syler clay, both in an untreated and acid treated state, all at 14% clay solids content in water. These measurements were carried out using a Fann model 38A. Recording Viscosimiter designed to plot torque versus shear rate on a suitable recording instrument, producing a complete rheogram of the material being tested. The instrument has the capacity for speed programming, allowing the shear rate to be constantly increased or decreased under either automatic or manual control at a rate best suited to the behavior of the particular system being measured, up to any top speed within the range of 200–1000 rpm. In the automatic mode, the instrument operates on a cycle, moving from zero speed up to the predetermined top speed within a selected time interval and then returning to zero at the same rate, with the time interval capacity ranging from 2–20 minutes. The values as plotted in FIG. 1 were obtained during the second half of this cycle through the range of 600–50 rpm.

The thixotropy of the untreated clay samples is marked, approaching infinite viscosity as the shear rate approaches zero. The curve representing the acid-treated samples actually is a composite of values obtained with samples subjected to acid treatment for periods of 2, 4, 8, 12 and 16 hours respectively. At the scale of FIG. 1, all of these values are so clustered as to fit a substantially common curve.

The differential effect on viscosity behavior of varying duration of acid treatment is visually depicted in FIG. 2 wherein a sample of the same Bates Hole clay is tested as before except that the solids content is approximately doubled to 27% by weight. At this level, the thixotropic nature of the untreated raw clay was so pronounced as to preclude any measurement and no curve for the untreated sample appears in this figure. At this concentration, however, the resultant viscosity curves for clay samples treated for the indicated period of time are distinct, although one will observe that all of the values obtained for samples treated in excess of two hours are positioned closely together, and perhaps within the limits of experimental error, noting that the plotted curve for the sample having 16 hours of treatment is slightly higher than the curves for the samples treated 6 hours and 8 hours respectively. Even with the minimum period of acid treatment, the substantially constant viscosity is quite apparent, proving the essentially Newtonian viscosity behavior of all of the acid treated samples.

Figure 3:
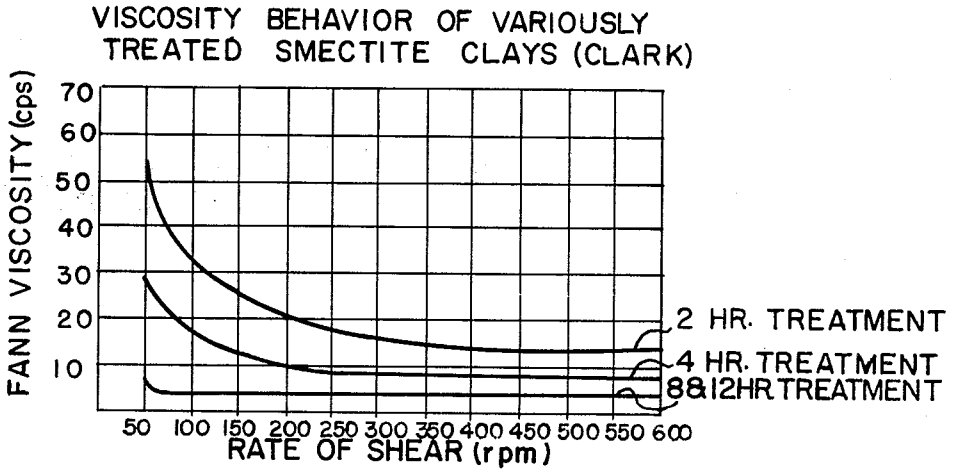
FIG. 3 is a plot similar to FIG. 2 for a different chemically modified clay in accordance with the invention, also measured at a concentration of 14% solids.

FIG. 3 records results similar to FIG. 1 for a Clark clay, measured at a concentration of 14% solids. Here the samples subjected to two and four hours acid treatment, respectively, show slight thixotropic effect but compared to the untreated samples, these samples can still be considered as having substantially constant, i.e., Newtonian, viscosity. The values for the samples treated 8 and 12 hours respectively were almost identical and thus share a common curve.

Figure 4:
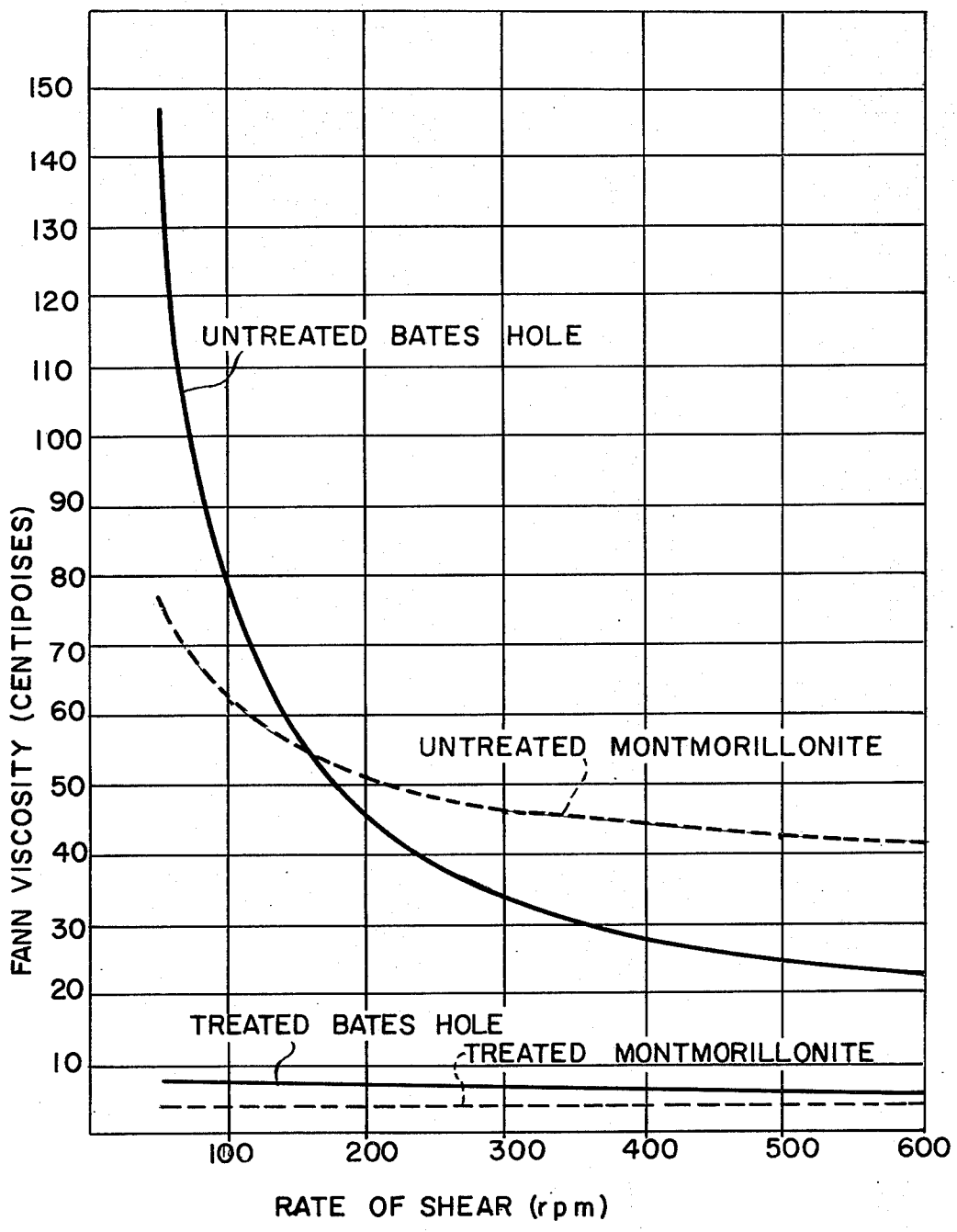
FIG. 4 compares the thixotropic properties of "artificial bentonite clays" made by mixing a bentonite clay or Montmorillonite, an active clay component derived from natural bentonite, both chemically modified in accordance with the invention, with major proportions of natural kaolin.

Despite the fact that kaolin clay does not exhibit the same adverse viscosity behavior as does the smectite clays of the present invention and is therefore known to be appropriate for paper coating purposes, dilution of a smectite clay by even large proportions of kaolin with the expectation of reducing the thixotropic behavior of the smectite clay to manageable proportions does not in fact accomplish this objective. This can be seen from FIG. 4 which sets forth curves obtained from viscosity tests carried out in the manner explained before on mixtures in the proportion of 3:1 of kaolin (KCS kaolin) with Montmorillonite clay mineral without acid treatment, on the one hand, and with treatment for 4, 8, 16 and 24 hours respectively, measured at a solids content of 20% of the mixture, together with mixtures in the weight ratio of 3:2 of a different kaolin (Astrabrite kaolin) and a Clark smectite clay that was untreated and treated for the same 4, 8, 16 and 24 hours respectively, measured at a solids content of 30% by weight. Despite the "dilution" of the smectite clay material with the larger proportion of kaolin, the thixotropic behavior of the untreated smectite material remained highly pronounced, the viscosities of the mixtures containing untreated smectite clay approaching infinity with zero shear rate. The flattening effect of an acid treatment of any duration on the viscosity of the mixtures containing the acid treated samples is most apparent and the values obtained for all of the treated samples in the two series of tests shown in FIG. 4 were very similar to one another as the curves show.

ANALYTICAL PROCEDURES FOR DETERMINING CHEMICAL MODIFICATION OF CLAY

While from a practical standpoint the ultimate test of the suitability of a given chemical modification of the smectite clay for purposes of this invention is whether or not the thus treated clay can, in fact, be handled by conventional sheet coating equipment, there are certain more sophisticated laboratory procedures that can be applied to clay samples to determine if they are within the scope of this invention. A preferred procedure for such a determination is based upon the X-ray diffraction characteristics of the clay. The use of X-ray diffraction for chemical analytical testing is now well established and there is no necessity for including here any elaborate explanation of the technique employed in this procedure. Ample literature is available which can be consulted for a complete understanding, both of the theoretical and practical aspects, of X-ray diffraction, for example, *Elements of X-Ray Diffraction*, by B. D. Cullity (Addison Wesley), especially Chapter 3 entitled "Diffraction I: The Directions of Diffracted Beams," and *Introduction to Modern Physics* by Richtmyer et al. published by McGraw Hill Book Co., especially Chapter 8, entitled "X-rays." Briefly, X-ray diffraction is based upon the principle that any crystalline chemical substance has a characteristic basal spacing between the planes of its crystals which will invariably identify that substance. If a powdered sample of the substance is impinged with a variable angle inclined beam of X-rays, the beam will be reflected by the crystalline planes and as any sample will include as a matter of statistical probability a certain number of crystals in which the planes are arranged in a parallel orientation, at one precise beam angle designated "theta" ($\theta$), the X-rays reflected from these parallel oriented crystals will tend to reinforce one another and produce a diffracted beam characteristic of the given cyrstalline spacing. By appropriate trigonometric calculation using 20, the actual distance for the basal spacing can be set.

The content of the crystalline substance in the sample will affect the intensity of the diffracted beam so that by measuring the intensity of the diffracted beam, one can obtain an indication or approximation of the amount within the sample of the crystalline substance. This relationship is important here since the acid treatment applied to the smectite clay appears, as already stated to remove the Montmorillonite clay structure from the clay substantially in proportion to the time of such treatment. Hence, X-ray diffraction of a clay sample enables one to ascertain if sufficient Montmorillonite clay mineral structure exists to adapt the clay to the needs of the invention by observing the presence of a discernible peak at the characteristic 20 value for that structure.

The X-ray diffraction reading can be taken from the clay sample alone but clearer patterns can usually be obtained by taking advantage of the known capacity of Montmorillonite to adsorb certain organic compounds to form "complexes." These complexes have a basal interlayer spacing determined by the nature of the organic compound which is fixed for each "complex" and can be used to identify that particular complex even when present in an unknown mixture of clays (see *Introduction to Clay Colloid Chemistry* by Olphen, interscience, 1963, page 167). One such compound previously used in the art for this purpose is ethylene glycol which gives with Montmorillonite a basal spacing of 17A.

It has been discovered that despite their non-polar nature the dye precursors employed for image formation in the invention are themselves capable of combining with Montmorillonite clay mineral to give similar complexes each having a fixed characteristic basal interlayer spacing. Accordingly, one is limited to special test compounds for analyzing the clay, although these can be employed if desired, but has the option of working direction with any combination of precursor and clay.

The X-ray diffraction examination is preferably carried out with the aid of one of the complex-forming organic compounds. As will be seen, for the same sample of clay, the characteristic peak will be distinctly sharpened or concentrated and the intensity thereof will be "exaggerated" or magnified when the organic compound is provided, making for much easier evaluation of the test results.

Values for $2\theta$ and the basal interlayer spacing for several representative combinations of smectite clays and organic compounds are given in the following tabulation:

| Clay and Organic Compound Combination | | $2\theta$(°) | Interlayer Spacing (A°) |
|---|---|---|---|
| Bates Hole clay, | ethylene glycol | 5.2 | 17 |
| Bates Hole clay, | Crystal Violet carbinol | 4.1 | 21.5 |
| Montmorillonite, | morpholine leuco-auramine | 5.8 | 15.2 |
| Bates Hole clay, | benzyl ether of Michler's hydrol | 5.7 | 15.5 |
| Clark clay, | " | 5.6 | 15.77 |
| Syler clay, | " | 5.6 | 15.77 |
| Syler clay alone, | " | 6.3 | 14.01 |

DESCRIPTION OF X-RAY DIFFRACTION RECORDINGS OF FIGS. 5–7

Figure 5:
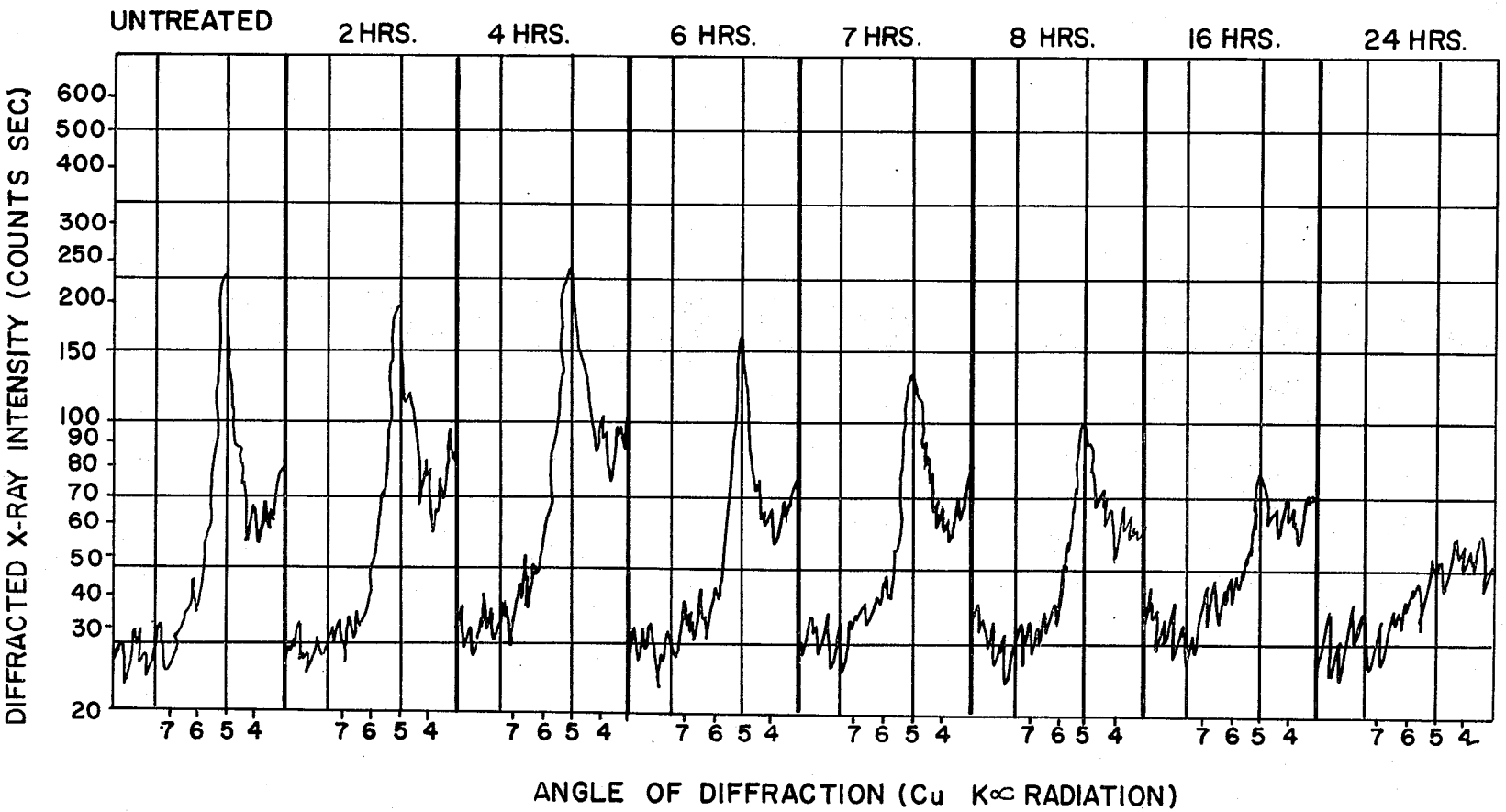
FIG. 5 is a reproduction of a series of X-ray diffraction tracings obtained by X-ray diffraction of samples of natural bentonite clay and after chemical modification to varying degrees in accordance with the invention containing adsorbed ethylene glycol, and showing the characteristic change in the diffraction pattern in the clay as a result of such chemical modification, the tracings being arranged on a common abscissa for easy comparison.

In FIg. 5 there is a series of X-ray diffraction recordings for a set of clay samples of a Bates Hole clay in its untreated state and seven examples of progressively increasing acid treatment ranging from 2 hours to 24 hours. In these recordings the clay samples contained absorbed ethylene glycol. The instrument used was a General Electric Defractometer, Model XRD6 with Cuk and Ni-filtered radiation.

In the recordings seen in FIG. 5, the intensity of the diffracted X-ray beam, measured in counts per second, is plotted on a log scale in the ordinate direction against an arithmetic scale in the abscissa direction representing twice the actual angle of diffraction $2\theta$. An unmistakeably sharp peak appears in the region of $2\theta$=5.2 that is characteristic of a Montmorillonite layer structure in the presence of ethylene glycol. An almost quantitative correlation between the extent of acid treatment and the height of the identifying peak is clearly visible in the series of seven treated samples in FIG. 5, culminating in the far-right sample which was treated for 24 hours and shows no identifiable peak at all. In this connection, it will be observed that all of the recordings of this series have a common base line or curve from which the characteristic peak located at $2\theta = 5.2$ projects and this base curve, which represents the background X-ray radiation, persists with more or less similar shape throughout the entirety of the series, obviously, the background radiation must be taken into consideration in evaluating the presence and the extent of the characteristic peak which constitutes the critical portion of the recordings for the purpose of identifying the Montmorillonite clay layer structure and should not be confused with that peak. For instance, the second recording from the right of FIG. 5 corresponds to the sample given a 16-hour acid treatment and in this recording a very slight residual peak can be detected at the $2\theta = 5$ location, projecting beyond the curvature of the base line, whereas in the last sample at the right, the peak in question has entirely disappeared.

Figure 6:
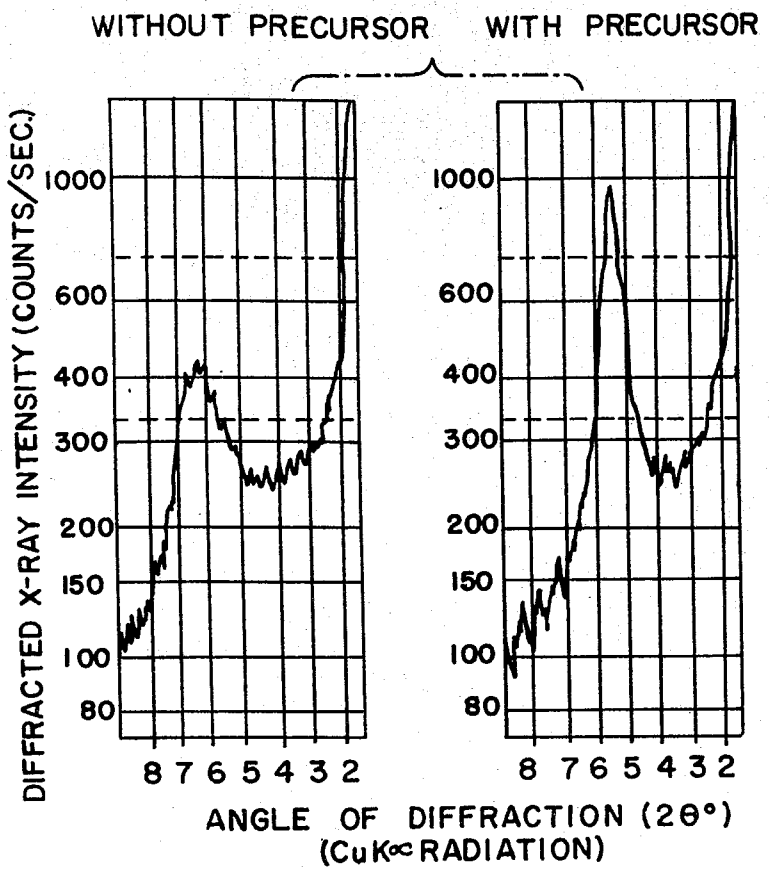
FIG. 6 shows X-ray diffraction tracings like those of FIG. 5 but obtained from a sample of chemically modified clay alone and after adsorption thereby of a dye precursor compound as contemplated herein.

FIG. 6 illustrates the advantage of using for the diffraction tests samples containing an adsorbed organic molecule by comparing a tracing for an acid-treated smectite clay alone and the same clay with one of the dye precursor compounds, i.e., benzyl ether of Michler's hydrol, absorbed theron. The shift in the characteristic interlayer spacing measured by $2\theta$ as well as the magnification of the intensification of the intensity of the peak is most evident.

Figure 7:
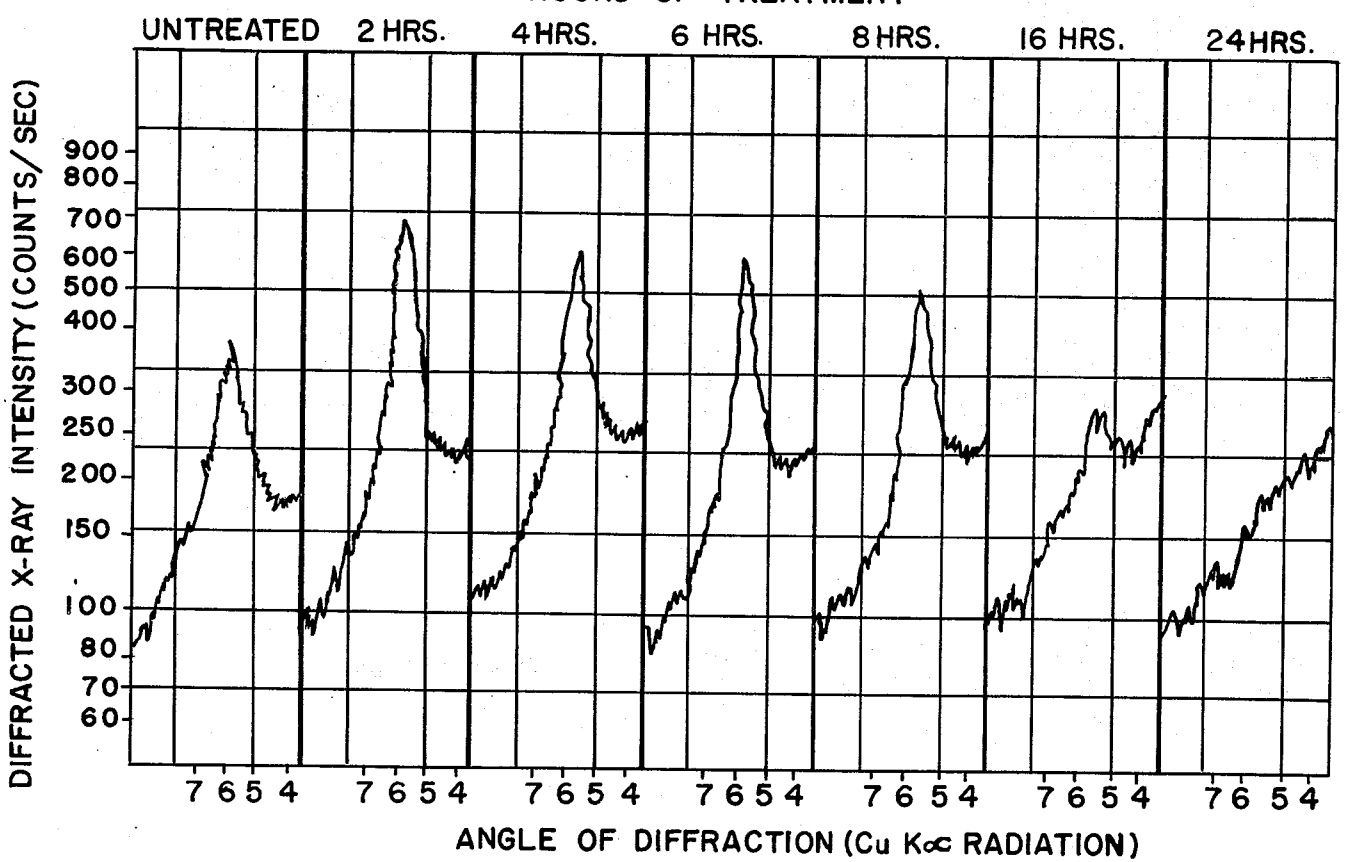
FIG. 7 is a reproduction similar to FIG. 5 of untreated and variously treated clay samples containing absorbed dye precursor compound and again showing the effect on the diffraction pattern of the clay of the extent of the chemical modification of the invention.

FIG. 7 is a plot of a set of tracings similar to FIG. 5 for a Bates Hole clay untreated and with various degrees of treatment as specified containing absorbed benzyl ether of Michler's hydrol. This comparison is particularly meaningful for its demonstration of the apparent effect of the acid treatment in increasing the affinity of the smectite clay for the precursor, in the case of the 2, 4, 6 and 8 hour leached clay.

The intensity values given by X-ray diffraction data obtained with different smectite clays or even the same clay obtained at different times or at different locations in the same deposit may, and most typically will, vary rather widely, which is to say that the height of the peak may reach widely different levels. Hence, the quantitative indication supplied by the height of such peaks of the content of Montmorillonite clay structure in a given sample is primarily significant in relation to similar data obtained with the same sample but treated to some different extent. In other words, an absolute correlation cannot feasibly be drawn between a given peak height and a corresponding content of Montmorillonite clay structure. This is particularly true since the height of the peak is altered by the absorption of organic molecules, as mentioned above in connection with FIG. 6, and will differ with different organic compounds. Nevertheless, the X-ray diffraction data is a reliable analytical device for identifying clays within the scope of the invention inasmuch as the presence of a discernible peak of the type shown in the tracings of FIGS. 5–7 is a definite characteristic of an expanding lattice clay of the Montmorillonite structure.

As will be established in detail subsequently, the rate of fading of clays useful for this invention shows a broad general correlation with the extent of chemical modification of the clay structure and where such chemical modification is accomplished through the acid treatment described above, the clay samples which have been treated for the longer periods of time show greater fading rates compared to the samples treated for lesser periods of time. This loss in resistance to fading reaches a maximum with clays treated sufficiently to destroy substantially all of the Montmorillonite clay structure originally present therein, such as those samples shown at the far right of FIGS. 5 and 7, each corresponding to a treatment time of 24 hours. Complete destruction of the Montmorillonite clay structure in the clays of the invention is not preferred for this invention since the fading characteristic of totally modified smectite clays may not exceed the fading results achieved with other clays of the prior art, namely kaolin and attapulgite. Circumstances may exist, of course, where the use of the smectite clay would be advantageous for reasons other than increased durability of the images obtained therewith and, in that event, the use of the completely modified clays would be of some value. Ordinarily, however, it is preferred that the extent of chemical modification permissible in accordance with this invention be less than that required to completely degrade the characteristic Montmorillonite clay structure. Consequently, the clays which are preferably and ordinarily useful for purposes of the invention will show on X-ray diffraction examination at least a rudimentary or discernible peak comparable in configuration to that seen in the tracing for the samples in FIGS. 5 and 7 which received a 16-hour acid treatment. The presence of even a small amount of the Montmorillonite clay structure has been found to be sufficient to impart to the images obtained with such clays a high resistance to fading which falls off sharply only where the Montmorillonite structure has been substantially completely destroyed as indicated by the absence of any perceptible or discernible peak in the X-ray diffraction data.

Repeated experimentation has established the fact that the extent of the acid treatment preferably used for effecting the desired chemical modification of the clay cannot itself be directly correlated with the content of Montmorillonite structure remaining in the clay after such treatment. This is because of the differences in the various clays included in the scope of the present invention and their consequential variable response to given times of treatment. Thus, while the times of treatment may give an approximate indication of the extent of removal of the Montmorillonite clay structure from a particular clay sample in the sense that a given clay treated for 8 hours will be found to possess a lower content of the characteristic structure than the same clay treated for a period of two or four hours, where different clays are being treated one cannot necessarily conclude that a 16-hour treatment of one clay will result in a lower Montmorillonite content than an 8-hour treatment of a different type of clay.

OTHER USEFUL ANALYTICAL TESTS

In addition to the X-ray diffraction data, useful information concerning the clays of the invention can be obtained by determination of the hydrated silica content and of the alumina content. The hydrated silica content is preferably measured with a Spectrophotometer or appropriate Colorimeter such as a Taylor Water Analyzer equipped with a silica slide. A 1-gram sample of the clay is prepared for analysis by boiling in 100 ml distilled water made alkaline with two grams of sodium carbonate for ten minutes, filtered and the residue re-boiled with additional 25 ml of the sodium carbonate solution for a few minutes. The residue is refiltered, washed with sodium carbonate solution, then washed several times with 25 ml of a 2% sodium chloride solution warmed to 180°F. All of the filtrate is collected and diluted with distilled water to make 500 ml from which a 5 ml aliquot portion is taken and diluted with additional distilled water to about 90 ml. To this solution is added 2 ml of 10% ammonium molybdate plus 1 ml of four normal solution of sulfuric acid and sufficient distilled water to make 100 ml. A pH of 1.8–2.0 should exist for this solution. After waiting a few minutes for color development to take place in full, the color intensity is measured with the instrument and the silica content in ppm is determined from the calibration scale. A control or blank sample for the reagents and the water should be run to allow for correction for any silica content therein and the difference between the determined silica content and the blank silica content in parts per million divided by the weight of the sample corrected for moisture content and other volatile matter (as measured by loss on ignition) gives the hydrated silica content in weight per cent.

As a result of the chemical modification of the clay structure in accordance with this invention, the hydrated silica value of any given sample of treated clay will be higher than the value for an untreated sample of the same clay. Thus, an increase in the hydrated silica content establishes that an irreversible chemical modification of the clay structure has been effected. An increase in this content of at least about 2–3% at a minimum is preferred.

The procedures to be followed in analyzing the clay for alumina content will be well known to the skilled chemist and need not be detailed here. In brief, the total oxide content of the sample is determined after extraction with sulfuric acid, hydrochloric acid and nitric acid. The total content of iron and titanium are then determined, using the standard analytical procedures available therefor, and subtraction of the iron oxide content and the titanium oxide content from the total oxide content establishes the percentage of alumina. The effect of the acid treatment of the present invention is to reduce the alumina content of the clay and a reduction in the order of at least about 2–3% by weight in the alumina content is considered the minimum change necessary for the purposes of this invention.

THE DYE PRECURSOR COMPOUNDS FOR IMAGE FORMATION

As already stated, the chemical mechanism for forming the colored images on record materials carrying the improved clays of the present invention is the well-known electron donor-acceptor color-forming mechanism which has been utilized for the same purpose in numerous patents in this art and, as a general rule, it can be accepted that any colorless dye precursor compound recognized by those skilled in this art as acceptable as the electron donor reactant in this reaction will be equally suitable in the practice of this invention. The selection of specific dye precursors is not therefore to be considered as a critical part of the novelty of the present invention and the same criteria usually applied in making this selection for purposes of the copying systems hitherto known in the art can be followed with equally good results here. The various patents identified in the introduction to this description include fairly detailed lists of the classes and specific examples taken therefrom of operative dye precursor compounds and these disclosures are hereby incorporated by reference. One useful list appears in U.S. Pat. No. 3,455,721, for example. Compounds that have been used with good results in the course of the experimentation preceeding this application include Crystal Violet lactone, Malacite Green lactone, Michler's hydrol, methyl and benzyl ethers of Michler's hydrol, p-toluene sulfinate of Michler's hydrol, acetyl oxime of Michler's hydrol, dimethanol ether of Michler's hydrol, Crystal Violet carbinol, benzyl ether of Crystal Violet carbinol, Ethyl Violet carbinol, and morpholine leucoauramine, among others. All of these compounds are precursors of diphenyl- and triphenyl-methane dyes which are preferred for use herein.

The initial color of the dye precursor is not of critical importance, as a matter of principle, and is governed primarily by practical considerations governed by the appearance of the particular record material being manufactured. It is important, of course, that whatever the starting color of the precursor it vary distinctively from the ultimate color developed in the image as a result of the electron exchange mechanism. Under average conditions, substantially color free compounds will be found to be best from the standpoint of aesthetic appeal of the ultimate record material, but compounds with light tints or hues can usually be tolerated without serious objection. Taking into account these possibilities, one should construe the term "colorless" as employed throughout this description in a generally relative sense as denoting the absence of any color that would correspond too closely or fail to sufficiently contrast with the color taken on by the ultimately developed image.

RESULTS OF COMPARATIVE FADING TESTS

Figure 8:
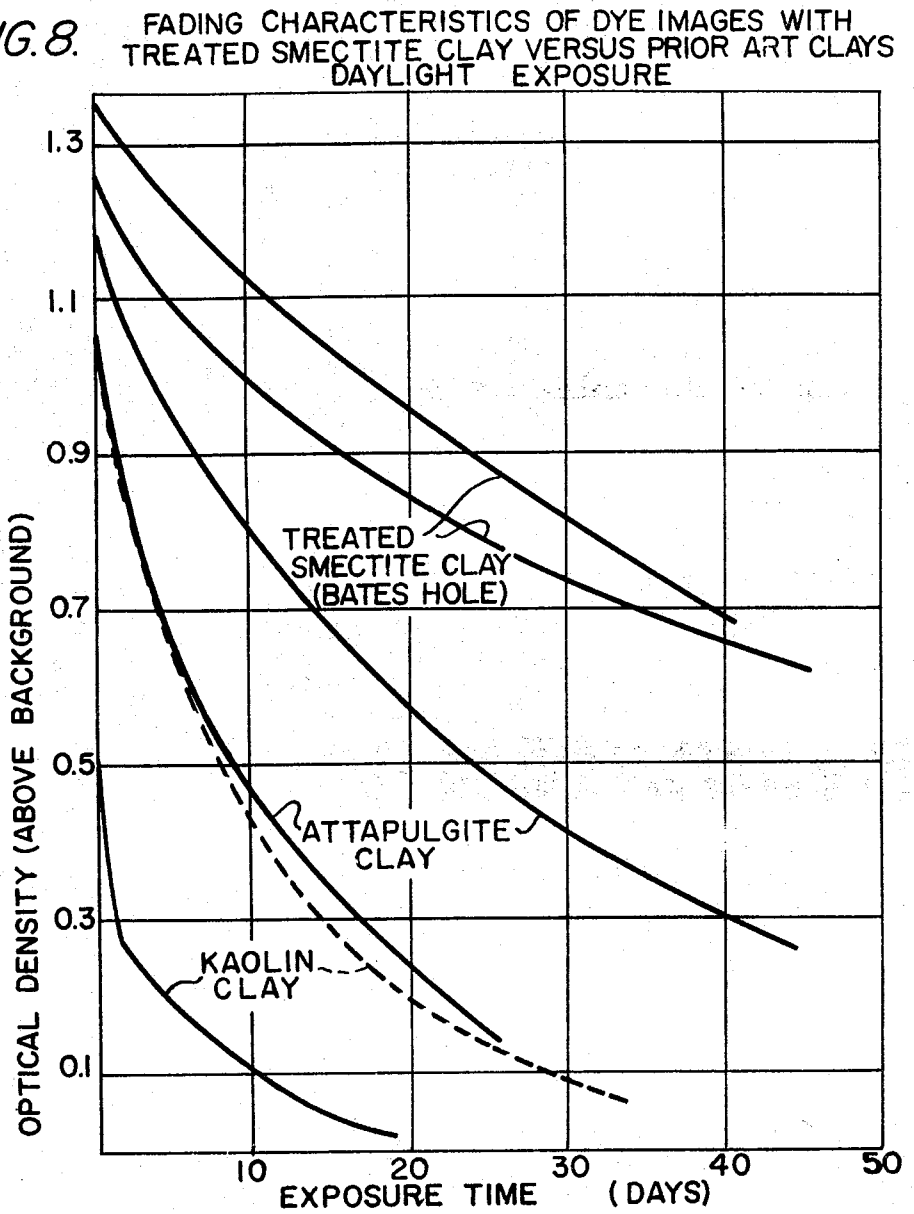
FIG. 8 shows fading rate curves for images obtained from two dye precursor compounds with a chemically modified bentonite clay of the invention, an attapulgite clay, and a kaolin clay on exposure to south daylight.

The important improvement afforded by the chemically modified clays of this invention with respect to enhanced resistance to fading of the colored images developed thereon with the color precursors of the sort identified above is perhaps best demonstated by a comparison against results obtained under similar conditions using other conventional clays, typified by kaolin clay and attapulgite clay. To this end, reference is made to FIG. 8 of the drawings which sets forth curves showing the effect on image density of prolonged exposure to south daylight. The experiments from which these results were obtained were carried out simultaneously on three samples of clays including an acid treated smectite clay within the scope of the present invention, an attapulgite clay, and a kaolin clay (both of which are outside the scope of this invention). In order to reflect possible different behavior of different precursors with these three different types of clays, two fairly divergent precursor compounds were employed, namely morpholine leucoauramine and Crystal Violet carbinol. The image density values are expressed in terms of the density above the initial background of the sheet and these values were obtained using a MacBeth densitometer, Model RD-100, following the instructions in the "owner's manual" supplied with that instrument. The colored images which were subjected to these density measurements were produced in the following way. Samples of the same clay were coated on paper at a given weight of 7 grams per square meter (unless otherwise specified) and images were formed on the sheets thus prepared by marking with a pen or stylus a predetermined area of a transfer sheet carrying on its reverse surface a layer of microcapsules containing a precursor solution that had been prepared in a manner which will be described subsequently. The image was examined with the densitometer and the location of the reading point marked to permit subsequent readings at the same point. The background density was then taken by reading an unimaged region of the sheet to provide a correction for whatever color was initially present in the sheet before imaging. The image sheet was then exposed without covering or other protection to lighting of the specified kind and periodically additional readings were taken. From these data, the period of time required for any given percentage of image density loss could be interpolated.

The difference between the rates of fading for the images obtained with the various clays is unmistakeably clear. The images corresponding to the attapulgite and kaolin clays had disappeared almost completely at the end of 25 days' exposure while the image given by the bentonite clay retained at least 50% of its original density over a 40-day period. The inferior performance of the kaolin is apparent with substantially complete color loss within 10 days. Somewhat better results were found when Crystal Violet carbinol was used as the dye precursor in lieu of the leucoauramine, although the kaolin continued to be much the poorest of the three.

Inasmuch as daylight lighting is highly variable and not subject to close reproduction, additional experiments were made wherein the exposure was to ordinary laboratory lighting by mounting samples obtained in the general manner just described on a vertical surface at a measured distance of 18 inches from a 96-inch long "Cool White" flourescent lamp with a rating of 110 watts and a T 12 bulb size. Temperature and humidity were those normally ambient in the laboratory. When used elsewhere here "laboratory lighting" is intended to refer to exposure at these conditions. The dye precursors used in this series of fading tests were Crystal Violet carbinol and EThyl Violet carbinol and the clays were the same three types used in connection with FIG. 8. Here again, the results as seen in FIG. 9 establish the acid treated clay of the invention as definitely superior with either precursor compound to the two prior art clays, with the results for the kaolin clay falling far below the other two.

Figure 9:
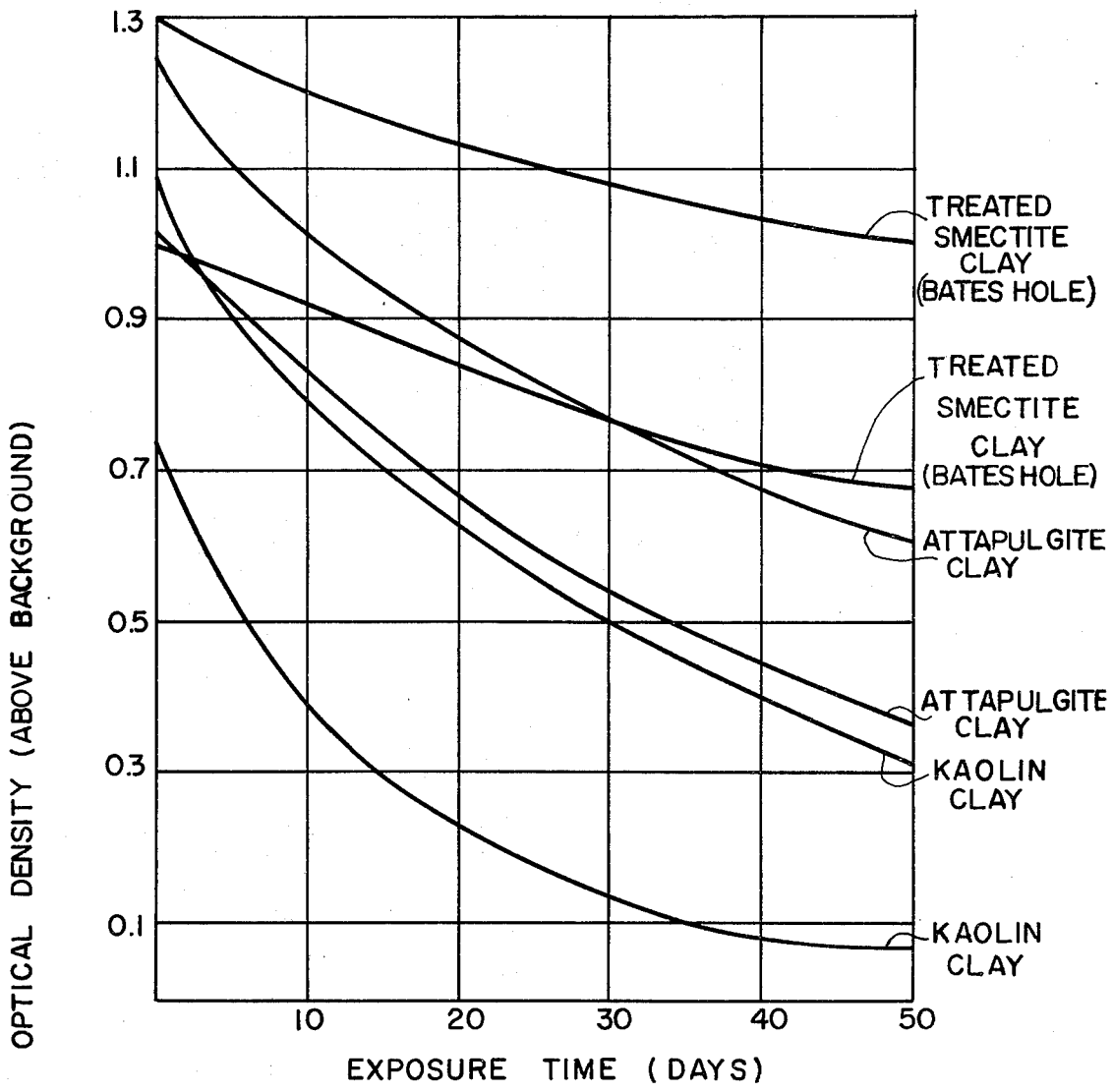
FIG. 9 is a similar plot of the fading rate curves for images obtained from two further dye precursor compounds with the same clays on exposure to laboratory lighting.
Figure 10:
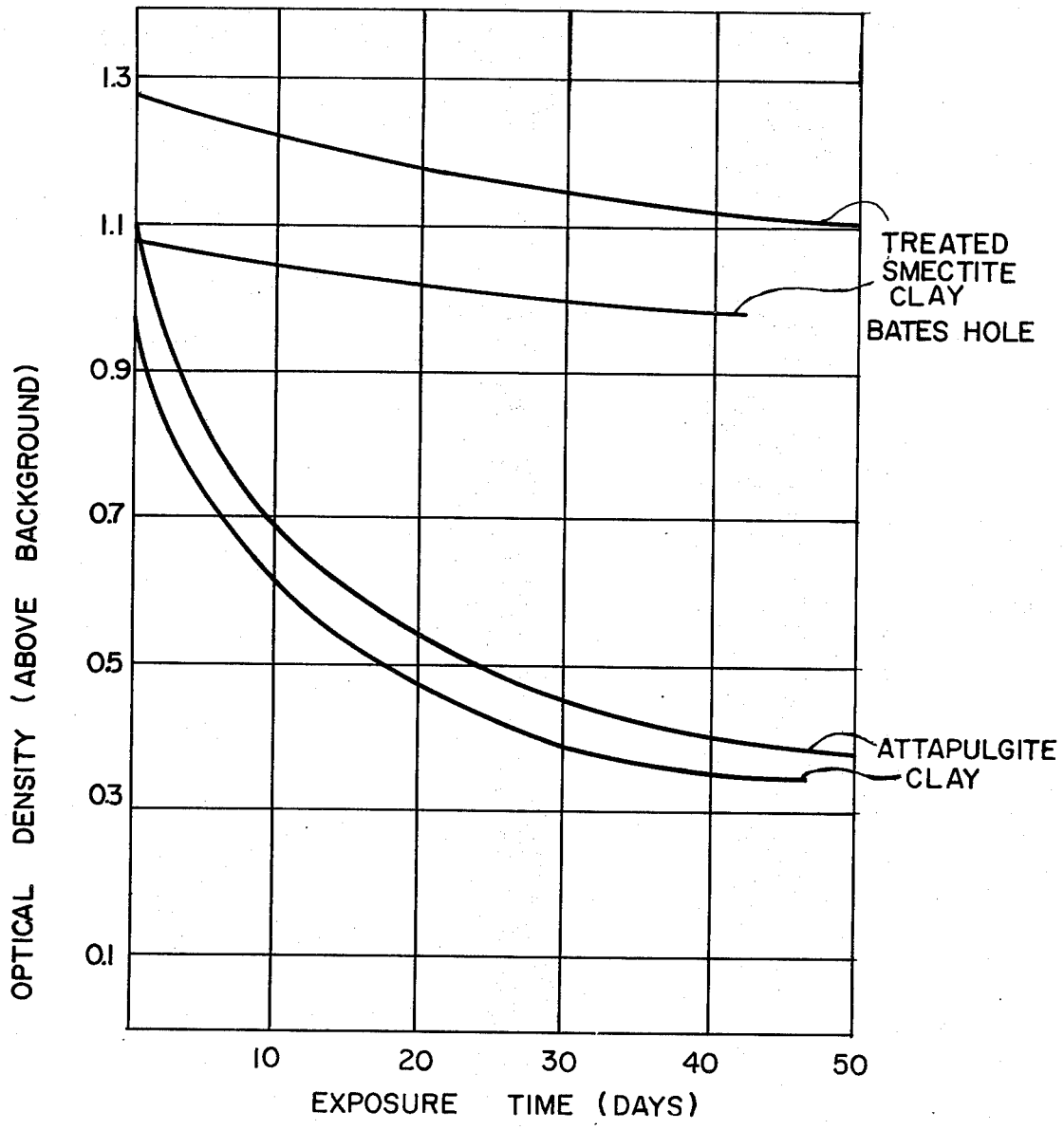
FIG. 10 is a similar plot of the fading rate curves of images obtained from one dye precursor of FIG. 7 plus a different dye precursor with a chemically modified bentonite clay and an attapulgite clay on exposure to laboratory lighting.

FIG. 10 shows the results of still further fading tests carried out under the same conditions as used for the experiments shown in FIG. 9 for images obtained using the two precursors, morpholine leucoauramine and methyl ether of Michler's hydrol, on an acid treated amectite clay and an attapulgite clay known from previous tests to be substantially superior to kaolin. The advantage in the clay of the invention was once more evident beyond question.

Perhaps of even more significance than the actual quantitative improvement provided by the clays of the invention is the general pattern of the curves obtained in all of these tests and especially so in the case of those represented by FIGS. 9 and 10. While the images obtained with the clays representing the invention do suffer some fading, on analyzing the curves in question one observes that the bulk of this fading occurs fairly early and the relative rate of fading becomes less and less as the time goes on. After a given period of time, while the image density remained at an easily legible level, the fading rate became essentially zero which means that from that time forward the image density remained substantially constant. In decided contrast, where the fading curves for the attapulgite and kaolin clays approach the condition of zero change in rate at all, the residual image density at that time is invariably far below that for the clays of the invention and in most instances is difficult if not impossible to read. Giving practical meaning to these results, it is that colored images obtained with the present clays will remain at a clearly visible level of image density for almost an indefinite period of time so that substantially permanent copies can be achieved.

Having thus established the improvement over the prior art clays by the smectite clays of this invention as a class, the relative effect on fading performance of varying degrees of chemical modification of the clay structure can now be examined in detail. Samples of two different clays, i.e., a Bates Hole clay and a mixture of Montmorillonite clay mineral and kaolin in the ratio of 1:3 by weight, were given acid treatments for 4 hours, 8 hours, 16 hours, and 24 hours, respectively, and images were produced on all of these samples as well as with an untreated control sample for each clay in the same way as before using methyl ether of Michler's hydrol as the precursor. The density measurements were made as explained and the exposure was to laboratory lighting, as defined above.

The sheets bearing the untreated clays used in these and subsequent tests were prepared by hand in the laboratory by placing a puddle of a dilute suspension of the untreated clay on the base sheet and drawing the puddle down into a coating with a hand manipulated wire-wound coating rod. The sheets thus obtained were weighed to insure a comparable weight of coating. While adequate for these comparative tests, these sheets were not of acceptable quality for commercial purposes.

Figure 11:
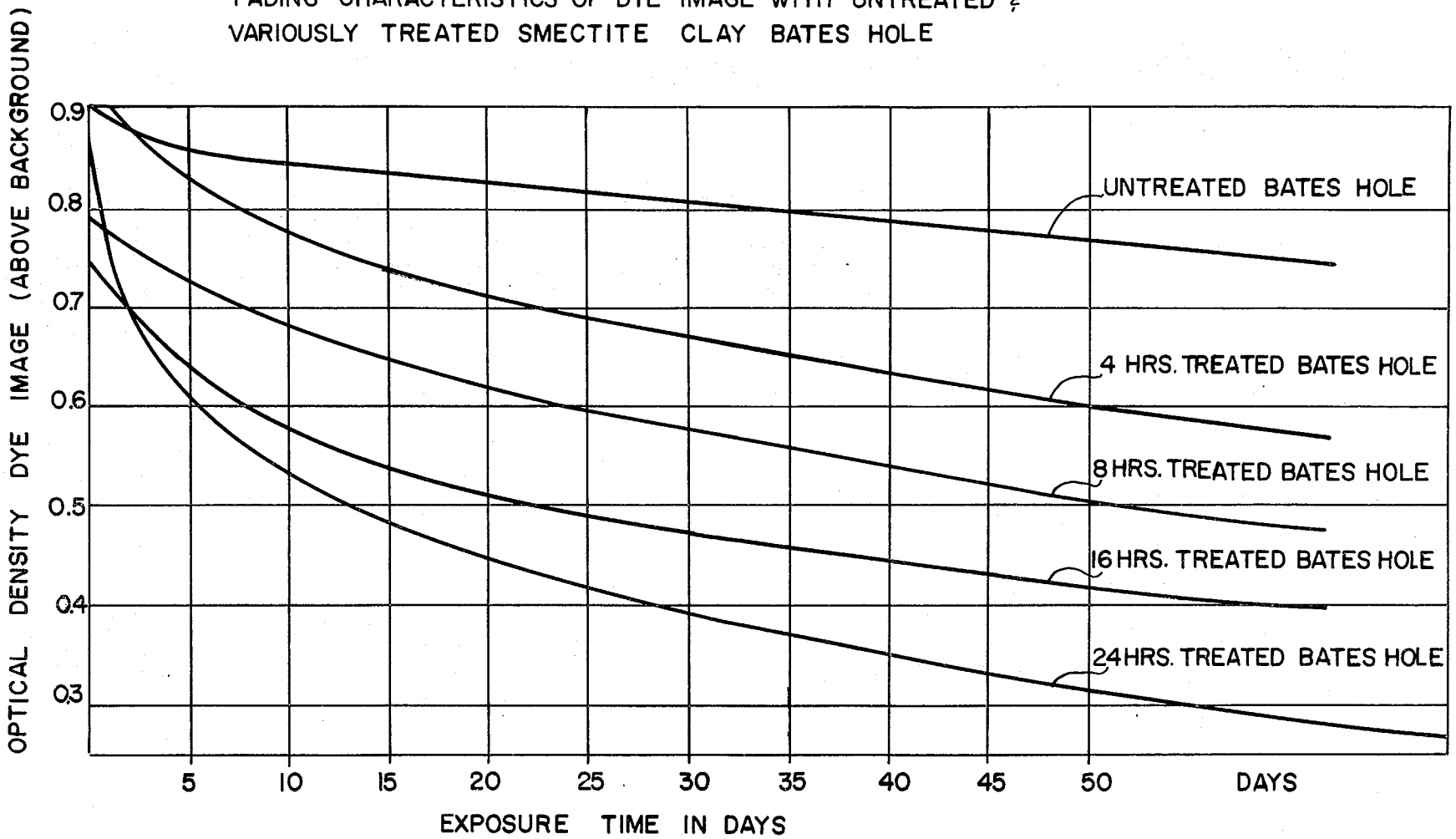
FIGS. 11 and 12 are image fading rate curves obtained with a bentonite clay in its unmodified natural form after various degrees of chemical modification in accordance with the invention and with Montmorillonite clay mineral in its unmodified form and after various degrees of chemical modification, indicating the relative fading rates for the natural and variously modified clay materials according to the invention.
Figure 12:
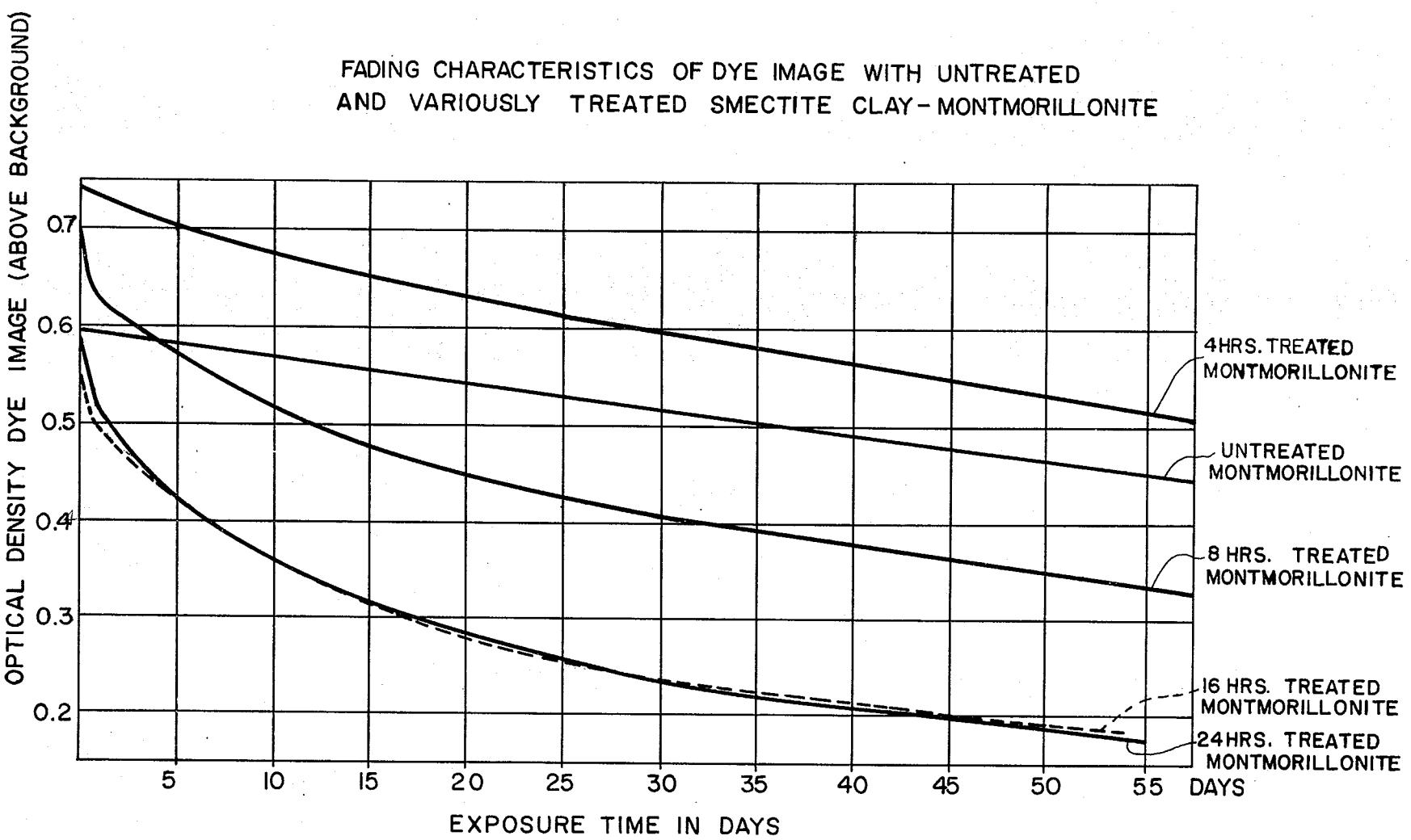

The fading curves for the Bates Hole samples appear in FIG. 11 and those for the Montmorillonite-kaolin mixture in FIG. 12. The gradually increasing rate of fading loss with increasing degree of chemical modification of the smectite clay can be discerned from these plots, together with the increasing loss in image density before the slope of the curves approximates the horizontal. These curves also show the fact that from the standpoint of image color permanence alone, the untreated smectite clay is superior to any of the treated clays, but the importance of these results must not be overrated since they are of academic significance only by reason of the unsuitability of the untreated clays for application as a usable coating on sheet material under any practical manufacturing conditions.

In effect, the present invention is based on the discovery that while the chemical modification of this invention has the effect of reducing the resistance of fading of images developed by the treated smectite clays as well as reducing the thixotropic behavior of those clays, the loss in thixotropic behavior occurs much more rapidly than does the loss in resistance to fading. Thus, practical advantage can be taken of the reduction in the thixotripic property without a corresponding loss in fading resistance. As the extent of chemical modification is increased, the point does come where the loss in fading resistance does become severe and, as has been mentioned previously, the preferred practice of the present invention excludes that degree of chemical modification which exceeds this point.

The following tabulation provides a simple basis for evaluating the results plotted in FIGS. 11 and 12 by extracting from the curves in each of those figures the time in days required for a 25% fading loss in image density to take place.

| Length of Acid Treatment | Time (Days) for 25% Fading Loss | |
|---|---|---|
| | Bates Hole | Montmorillonite |
| Untreated | 95.0 | 55.0 |
| 4 Hours | 25.5 | 37.5 |
| 8 Hours | 28.5 | 7.5 |
| 16 Hours | 12.0 | 4.2 |
| 24 Hours | 2.7 | 3.2 |

CORRELATION OF FADING RESULTS AND X-RAY DIFFRACTION DATA

In order to explore if some reasonable correlation existed between the fading characteristics of colored images obtained using the clays of the present invention with the X-ray diffraction tracings given by the same clays, a series of experiments were undertaken under conditions calculated to provide the desired comparison. In these experiments, weighed samples of the given clay were placed in a solution of known concentration of a given dye precursor compound in an appropriate solvent which was inert with respect to the clay and the precursor was allowed to absorb on the clay until equilibrium was reached. The clay was then removed from the precursor solution by filtering, washed with solvent, dried, and then subjected to analysis by the X-ray diffraction method mentioned above. The X-ray diffraction tracings obtained in this way were analyzed to determine the extent or height of any peak at the characteristic $2\theta$ value by establishing an average base line conforming with the general curvature of the background radiation in these tracings and then measuring the maximum projection above this base line of the characteristic peak. Applying this procedure, for example, to the sample at the far left end of FIG. 5, the base curve can be projected to pass through an intensity point equaling about 50 counts per second while the characteristic peak at the $2\theta$ value of 5.2 approximates 250 counts per second, the difference of approximately 200 counts per second is taken as the measure of the extent of the characteristic peak in the same intended here.

The solution of the dye precursor remaining after extraction of the clay was analyzed to determine the quantity of precursor actually taken up by the clay, using known colorimetric analytical procedures for this purpose, and such absorbed precursor was calculated in terms of the number of moles ($X\ 10^5$) per gram of clay. The fading data was obtained with sheets coated with the identical clay at a weight of 7 gms/sq.m. and images were formed on the sheets thus prepared using transfer sheets carrying microcapsules containing identical precursor solutions as described before. These images were exposed to light fading under laboratory lighting, as defined above, and periodically examined by the reflection densitometer as in previously described experiments. The time measured in days required for these images to undergo a fading loss in image density above background of 50% (herein designated $t_{50}$) was then determined.

In the following Table I, weighed samples of a Bates Hole clay and a mixture of Montmorillonite mineral and kaolin in a ratio of 1:3 by weight both untreated and treated to various times of acid treatment, as specified, were tested in conjunction with the dye precursors, benzyl ether of Crystal Violet carbinol and morpholine leucoauramine, dissolved in xylene at a concentration of 0.1 moles per liter.

TABLE I

| Ex. No. | Clay Treatment (Hours) | Amt. Precursor Absorbed (moles/g × $10^5$) | Peak X-Ray Intensity (Counts/Sec) | $t_{50}$ (Days) |
|---|---|---|---|---|
| A. BATES HOLE CLAY WITH BENZYL ETHER OF CRYSTAL VIOLET CARBINOL IN XYLENE | | | | |
| 1 0 | 11.6 | 610 | 65 | |
| 2 | 2 | 26.6 | 140 | 58 |
| 3 | 4 | 29.0 | 610 | 63 |
| 4 | 6 | 25.0 | 545 | 65 |
| 5 | 7 | 25.0 | 500 | 52 |
| 6 | 8 | 20.6 | 395 | 52 |
| 7 | 16 | 21.6 | 170 | 25 |
| 8 | 24 | 21.0 | 40 | 22 |
| B. 3:1 KAOLIN/MONTMORILLONITE CLAY MIXTURE WITH MORPHOLINE LEUCOAURAMINE IN XYLENE | | | | |
| 9 | 0 | 25.6 | 170 | 102.5 |
| 10 | 4 | 54.1 | 165 | 102.0 |
| 11 | 8 | 51.6 | 220 | 47.5 |
| 12 | 16 | 46.6 | 100 | 17.0 |
| 13 | 24 | 43.1 | 45 | 15.0 |

From the data recorded in the above Table I, one can see that a good correlation exists between the X-ray intensity peak values for the variously treated clays and the durability of images obtained therewith against actual fading loss.

Similar experiments carried out with other clays, specifically a Clark clay and a Syler clay used in conjunction with a different precursor, the benzyl ether of Michler's hydrol, dissolved in xylene at a 1/10 mole concentration. Samples obtained by equilibrium absorption of the precursor solution on weighed samples of the clays were analyzed as before for the quantity of precursor absorbed as well as the X-ray diffraction peak intensity thereof. Sheet material coated with these clays were imaged with precursor solutions as before and were tested for fading. To givie an indication of the effect on the fading rate of variation of a less volatile solvent for the precursor, an additional set of images were obtained using the precursor dissolved in dibutyl phthalate (BP = 340°C vs. 140°C for xylene) and were tested for fading in the same way. The data obtained in these experiments is summarized in the following Table II wherein the fading rates for the images obtained with the different precursor solutions are in separate columns, designated solvent "A" for xylene and solvent "B" for dibutyl phthalate.

TABLE II

| Ex. No. | Clay Trtmt Hours | Amt Prec. Absorbed (moles/g × $10^5$) | Peak X-Ray Intensity (counts/sec) | Time to 50% Fade Solvent A | Time to 50% Fade Solvent B |
|---|---|---|---|---|---|
| A. CLARK CLAY WITH BENZYL ETHER OF MICHLER'S HYDROL | | | | | |
| 14 | 2 | 45.0 | 990 | 90 | 106 |
| 15 | 4 | 45.0 | 1010 | 96 | 105 |
| 16 | 8 | 46.3 | 790 | 115 | 103 |
| 17 | 12 | 37.5 | 290 | 48 | 115 |

TABLE II-continued

| | | | | | |
|---|---|---|---|---|---|
| B. SYLER CLAY WITH BENZYL ETHER OF MICHLER'S HYDROL | | | | | |
| 18 | 0 | 36.3 | 710 | 140 | 120 |
| 19 | 2 | 55.0 | 650 | 175 | 140 |
| 20 | 4 | 55.0 | 680 | 160 | 140 |
| 21 | 8 | 60.0 | 650 | 130 | 115 |
| 22 | 12 | 55.0 | 310 | 69 | 100 |
| 23 | 16 | 51.2 | 260 | 43.5 | 85 |

The results set forth in Table II are interesting not only by reason of their close correspondence with the pattern of results seen in Table I, but for the light they shed on the possibility of obtaining even better fading resistance by means of less volatile solvents for the dye precursor. One can achieve a considerable measure of compensation for the loss fading resistance provided by the clay because of excessive chemical modification of its structure by selecting a solvent having a lower rate of evaporation.

EFFECT ON FADING OF SHEET HUMIDIFICATION

Marked variation in image durability as a function of varying humidity conditions is an obviously undesirable trait in any copying system and a further series of experiments was performed in order to determine how the images obtained on the clays of this invention were affected by varying humidity. These experiments followed the same general approach explained in connection with Tables I and II with respect to running equilibrium absorption tests and obtaining the X-ray diffraction readings, except that coated sheets were prepared at two different coating weights equaling 3.75 grams and 7.00 grams of clay per square meter of coated sheet surface. One set of these sheets was imaged in the same way as before while a replicate set was exposed to a humidified atmosphere before being imaged. The humidification was obtained by placing the sheets in a sealed container containing brine in a base compartment in open communication with the sheets but not in direct contact thererwith for 24 hours at a temperature of about 90°C. The sheets were then removed from the container and used promptly for image formation. The results of these tests appear in Part A of the following Table III wherein separate columns are given for the dry and humidified sheets at the two coating weights, designated A and B for the lower and higher weights, respectively. To furnish a general comparison between the performances of the sheets coated with the clays of this invention and with other clays, especially representative of the prior art, similar humidification tests were carried out with sheets coated with attapulgite clay at a coating weight of 7 gms/sq.m. and with samples of two commercial products, and the results appear in Part B of Table III.

TABLE III

| Ex. No. | Clay Trtmt Hours | Amt Pre. Absorbed (moles/g × $10^5$) | Peak X-Ray Intensity (counts/seconds) | Time to 50% Fading Loss — Days[11] Dry Sheets Coating Wt. A | Dry Sheets Coating Wt. B | Humid. Sheets Coating Wt. A | Humid. Sheets Coating Wt. B |
|---|---|---|---|---|---|---|---|
| A. BATES HOLE CLAY WITH BENZYL ETHER OF MICHLER'S HYDROL | | | | | | | |
| 24 | 0 | 17.6 | 190 | 265.0 | 275.0 | 270.0 | 265.0 |
| 25 | 2 | 25.0 | 490 | 330.0 | 340.0 | 330.0 | 370.0 |
| 26 | 4 | 27.6 | 400 | 265.0 | 245.0 | 300.0 | 315.0 |
| 27 | 6 | 26.4 | 390 | 265.0 | 260.0 | 275.0 | 310.0 |
| 28 | 7 | 23.6 | — | 290.0 | 290.0 | 295.0 | 285.0 |
| 29 | 8 | 21.6 | 340 | 250.0 | 235.0 | 240.0 | 270.0 |
| 30 | 16 | 13.0 | 120 | 57.5 | 112.5 | 62.5 | 145.6 |

TABLE III-continued

| | | | | | | | |
|---|---|---|---|---|---|---|---|
| 31 | 24 | 10.6 | 35 | 6.0 | 13.0 | 9.5 | 21.5 |

B. PRIOR ART CLAYS

| Type of Sheet | Time to 50% Fade (Days) Dry Sheets | Humidified Sheets |
|---|---|---|
| Attapulgite Clay-Coated (Attasorb RVM) | 20 | 35–42 |
| Commercial Copy Sheet X [2] | 35–42 | 40–45 |
| Commercial Copy Sheet Y [3] | 6 | 15–18 |

[1] All times in excess of 250 days are approximate.
[2] Random samples of leading commercial product, using attapulgite clay.
[3] Random samples of recent market entry.

In view of the rather poor results seen for the heavily treated clay samples in Part A of Table III, a similar group of experiments were carried out with a different batch of Bates Hole Clay. The equilibrium absorption and X-ray diffraction tests were omitted for this group of experiments as redundant. These experiments were carried out with two different precursors, as indicated, and for one precursor were performed in duplicate to indicate the margin of experimental error. The results are set forth in the following Table IV, with the duplicate experiments in Part B designated *a* and *b*.

TABLE IV

A. BATES HOLE CLAY WITH METHYL ETHER OF MICHLER'S HYDROL

| Ex. No. | Clay Trtmt (Hours) | Time to 50% Fade Dry Sheets | Humidified Sheets |
|---|---|---|---|
| 32 | 0 | 200 | 51 |
| 33 | 4 | 107 | 175 |
| 34 | 8 | 107 | 98 |
| 35 | 16 | 72 | 72 |
| 36 | 24 | 20 | 21 |

B. CLARK CLAY WITH BENZYL ETHER OF MICHLER'S HYDROL

| | | | |
|---|---|---|---|
| 37a | 0 | ca 275 | 250 |
| 37b | 0 | ca 275 | 256 |
| 38a | 4 | 256 | ca 296 |
| 38b | 4 | 255 | ca 286 |
| 39a | 8 | 235 | ca 276 |
| 39b | 8 | 215 | 266 |
| 40a | 16 | 182 | 210 |
| 40b | 16 | 164 | 210 |
| 41a | 24 | 42 | 65 |
| 41b | 24 | 30 | 65 |

EFFECT ON FADING OF PRECURSOR VARIATION

The effect of different dye precursor compounds on the fading rate of images produced therefrom on the sheet materials of the invention was explored in a final group of experiments using sheet materials coated with two different clays, namely a Syler clay and a Clark clay, with five different precursor solutions which, for purposes of simplified tabulation, will be identified as precursors 1–5 in accordance with the following identifying list:

Precursor 1 = p-toluene sulfinate of Michler's hydrol in dibutyl phthalate.

Precursor 2 = acetyl oxime of Michler's hydrol in dibutyl phthalate.

Precursor 3 = dimethanol ether of Michler's hydrol in dibutyl phthalate.

Precursor 4 = benzyl ether of Michler's hydrol in dibutyl phthalate.

Precursor 5 = benzyl ether of Michler's hydrol in xylene.

Images obtained using these precursor solutions with sheets coated with the indicated clays were made and tested for fading under laboratory lighting, as described above, and the results of these tests are tabulated in the following Table V.

TABLE V

A. SYLER CLAY WITH VARIOUS PRECURSORS

| Ex. No. | Clay Trtmt Hours | Time to 50% Fading Loss (Days) Pre. 1 | Pre. 2 | Pre. 3 | Pre. 4 | Pre. 5 |
|---|---|---|---|---|---|---|
| 42 | 0 | 21–23 | 20–23 | 20–23 | 22–23 | 45–48 |
| 43 | 2 | 63–65 | 63 | 63–65 | ca 65 | ca 90–100 |
| 44 | 4 | 63 | ca 70 | ca 70 | ca 70–75 | ca 90–95 |
| 45 | 8 | 53 | 62 | 58–60 | 57 | ca 60–65 |
| 46 | 12 | 32–34 | 39–40 | 41 | 39–40 | 22–23 |
| 47 | 16 | 36–40 | 44–45 | 45–48 | 43–45 | 23–25 |

B. CLARK CLAY WITH VARIOUS PRECURSORS

| | | | | | | |
|---|---|---|---|---|---|---|
| 48 | 2 | 37 | 39–41 | 41–46 | 39–41 | 48–51 |
| 49 | 4 | 40–42 | 43–44 | 42–43 | 43 | 52–54 |
| 50 | 8 | 40–43 | 48–52 | 54 | 40–50 | 45 |
| 51 | 12 | 39 | 46–49 | 48–50 | 45–48 | 21 |

The data summarized in the aforegoing Tables I–V fit into a distinct coherent pattern clearly revealing the order of the improvement in fading results accomplished with the practice of the present invention. Moreover, there can be discerned an unusually good correlation between the extent to which the clay structure has been chemically modified by varying duration of acid treatment and the usefulness of the clays in giving long-lasting valuable images with the conventional dye precursor compounds. Also established in the reliability of the X-ray diffraction technique as an analytical device for identifying the relative extent to which the structure of the clay has been chemically modified and degraded and determining the ultimate suitability of a clay for purposes of this invention. Indeed, the correspondence between the X-ray data from the equilibrium absorption tests and the fading results exhibited by actual imaging systems is remarkable, noting that the former represents ideal conditions and the latter practical working conditions. A number of different dye precursor compounds of rather widely varying chemical structure are proven to be more or less equally satisfactory and the clays contemplated here have been shown to be remarkably free of any susceptibility to desensitization by exposure to high atmospheric humidity prior to use thereof for imaging. Relatively non-volatile solvents for the dye precursors have also been established as superior to more volatile liquids, especially in conjunction with severely modified clays which would otherwise be expected to give decidedly inferior results and the selection of solvents of this kind as the carrier medium for the dye precursor compound provides a way of using to good advantage even relatively highly degraded smectite clays.

EFFECT ON FADING OF DYE PRECURSOR CONCENTRATION

Changes in the level of concentration of the dye precursor in the imagaing solution contacted with the clay-coatings of this invention will, of course, produce a corresponding change in the depth or intensity of the dye image developed as a result of the color-forming reaction mechanism and it is at least conceivably that the extent of developed image intensity could have some influence on the rate of fading of such images. To investigate this possibility, several series of experiments were undertaken, the results of which are summarized in FIGS. 13–16. For the series of experiments related to FIG. 13, samples of a Bates Hole clay untreated and treated to varying degrees of acid treatment were coated onto sheets and images were produced therewith using transfer sheets carrying capsules containing the selected dye precursor compound, in this case methyl ether of Michler's hydrol, at various solution concentrations in order to produce a set of developed images on the clay sheets whose density or color concentration initially varied over a substantial range. These samples were exposed to laboratory lighting, as defined above, and periodically examined for image fading by means of the reflection densitometer described above, the resultant readings were recorded and the time required for a 50% fading loss in image density above the background was determined. In FIG. 13, these values for 50% fading loss are plotted on a log scale against the log of the initial color concentration or image density measured above the initial background. The resultant curves show, first, the general loss in resistance to fading incidental to increasing chemical modification of the clay with increasing time of acid treatment, in common with all of the other experimental evidence discussed heretofore, and, second, the existance of an essentially straight-line relationship between fading rate to 50% loss and variation in the initial level of the image density for the clays of this invention. The untreated clay, on the other hand, appears to be free of any influence of concentration at low initial densities, i.e., below about 0.4, although at higher concentrations above that level, it behaved like the treated clays, following a substantially parallel line.

FIG. 14 is based on data obtained in generally the same fashion as for FIG. 13, differing only in that the clay sheets prepared from the untreated and variously treated Bates Hole clay samples were prior to image formation thereon humidified in a sealed container in the presence of a saturated brine solution at 80°C for 24 hours to reveal any desensitizing action by high humidities on the image-forming properties of these clays. Both methyl and benzyl ethers of Michler's hydrol were used as dye precursors. The fading times to 50% loss were obtained in the same way as for FIG. 13 and were plotted on the same scale for a number of different initial image density levels and these plots appear in FIG. 14. One can see that the untreated clay sample was actually inferior at fairly high image density levels to the relatively lightly treated clays of the invention, confirming the behavior indicated by the diffraction data in FIG. 7.

Similar sets of experiments were carried out with samples of Bates Hole clay untreated and treated to various extents prior to admixture with kaolin clay in the proportion of two parts of smectite clay to three parts of kaolin. For sake of comparison, sheets coated with the kaolin alone were tested in the same way. As before, the fading times to 50% loss in image density were plotted on a log scale against varying levels of initial image density and appear as FIG. 15. Several conclusions can be drawn from FIG. 15. First, the "dilution" of the active clays of the invention by even major amounts of an inactive clay does not by any means destroy the usefulness of those clays for image-forming purposes and, as a matter of fact, seems to have little effect on this property at all. Second, the incredibly bad performance of kaolin alone is evident even at relatively high starting image density levels when measured against the most severely treated clays of the invention.

Figure 16:
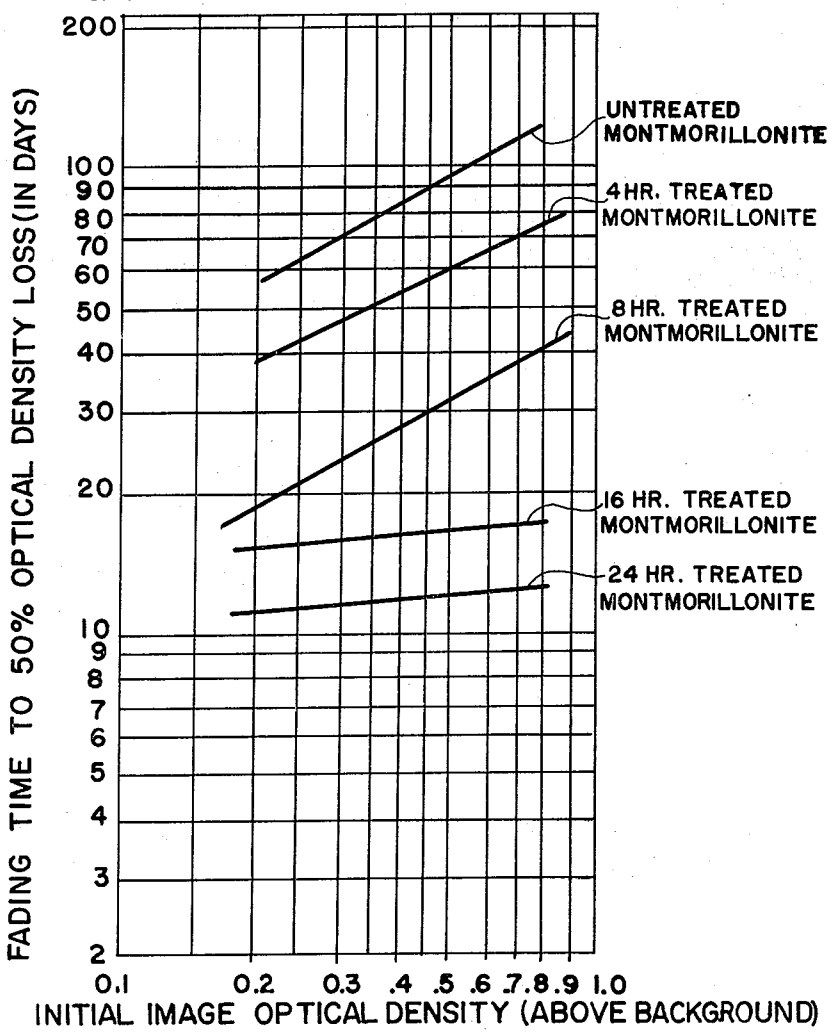
FIG. 16 is a characteristic fading curve similar to FIGS. 13-15 except that the images are obtained with an artificial bentonite clay made by mixing Montmorillonite clay mineral with a major proportion of kaolin.
Figure 15:
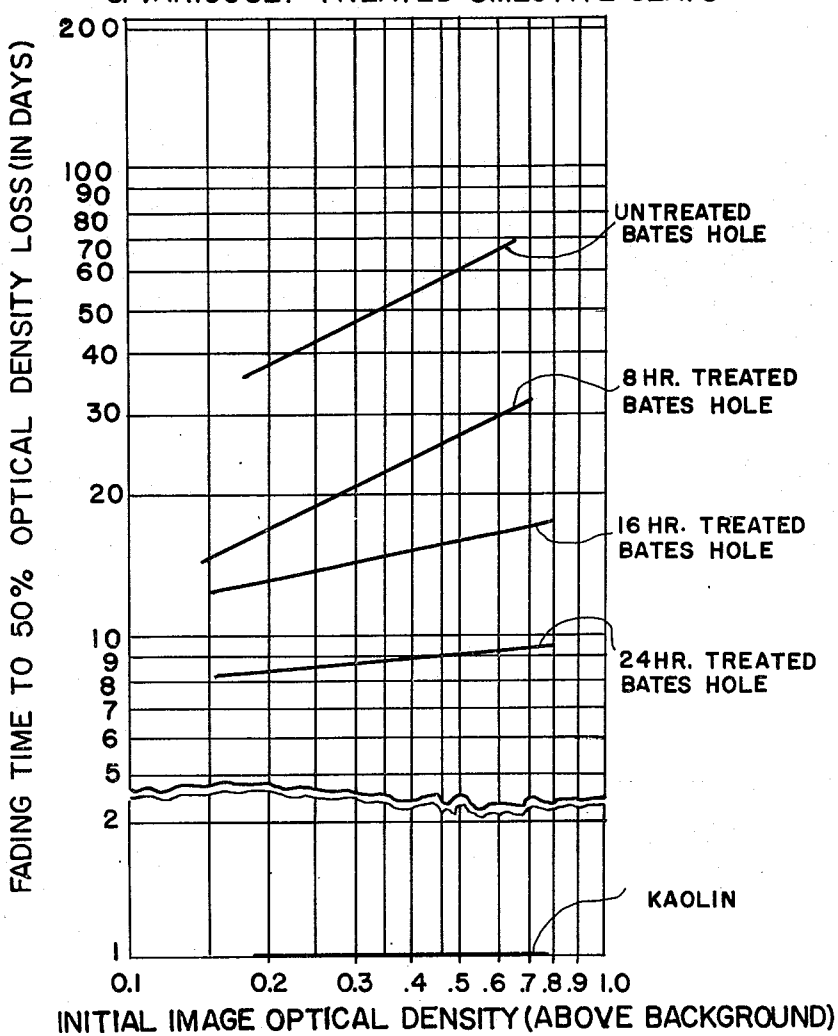
FIG. 15 is a characteristic fading curve similar to FIGS. 13 and 14 for images from the same precursor with a mixture of a bentonite clay and a major proportion of kaolin and with kaolin alone.

FIG. 16 is based on data similar to that for FIG. 15 except that the clay sheets tested were coated with 3:1 mixtures of kaolin and Montmorillonite clay mineral which, prior to admixture, were untreated and treated to various periods of acid treatment. The same test results were plotted in the same way and the curves therefor are reproduced in FIG. 16. In this figure, the severity of the fading loss of the more drastically treated clays of the invention shows up perhaps more readily than in other experiments carried out using other kinds of clays. One can speculate that the pure Montmorillonite in the mixture for FIG. 16, being free of other earthy materials, tended to be exposed more directly to the attack of the acid during the acid treatment so that the full brunt of the acid attack was concentrated on the Montmorillonite structure which therefore received greater degradation.

APPLICATION OF THE DYE PRECURSOR COMPOUND

The gist of the present invention resides in the improved record material carrying on a surface thereof a coating of one of the chemically modified smectite clays of the invention and, in principle, it is a matter of indifference in the practice of that concept how the dye precursor compound is brought into contact with that clay-coated surface to allow the image-forming reaction mechanism to occur thereon. A variety of different techniques for applying the dye precursor compound image-wise fashion to the record material of the invention is available to the skilled worker in the art. For instance, the dye precursor compound could be contained in an "ink" dispensed by means of a conventional fountain pen or by one of the newer felt-tipped marking pens. Alternatively, the dye precursor commpound could be used in a solution saturating a felt stamp pad and rubber stamps carrying the desired image could be moistened from such pads and brought into contact with the record materials to apply the precursor solution thereto. A further technique could employ the newer type of "rubber" stamp which is porous in character, being impregnated with an ink solution adapted to be exuded in metered quantity from the pores under application pressure, so as to be useful for many hundreds of impressions. See, for example, British patent No. 1,073,454. A preferred way of applying the precursor compound is by way of a transfer sheet carrying on one of its surfaces a coating containing the dye precursor compound in a form that is releasable when the transfer sheet is subjected to marking pressure either during writing with a pen or stylus, under the impact of a typewriter key or otherwise. The solutions of precursor compounds satisfactory here lend themselves to use in conjunction with virtually any of the known types of transfer sheets used heretofore for similar record systems and a particularly desirable transfer sheet has the precursor compound contained within microcapsules distributed in the form of an adherent layer on an appropriate supporting sheet, such as paper or the like.

Numerous patents have issued in the past 20 years or so covering various techniques for making microcapsules from various reactants with various properties. Virtually any of these techniques could be adapted to the encapsulation of solutions of the dye precursor compounds contemplated here, subject only to the obvious limitations that the microcapsule wall-forming material itself and the solvent liquid contained therein be free of any antagonistic or detrimental effect on the clays of the invention and/of the reaction mechanism for developing the color image. These include the relatively early Green et al. U.S. Pat. Nos. 2,800,457 and 2,800,458, and the Brynko et al. U.S. Pat. Nos. 2,969,330 and 2,969,331, together with the various improvements thereon now found in the patented art. Mention can also be made of the Vassiliades U.S. Pat. Nos. 3,418,250 and 3,418,656, as well as the several patents to Reys, such as U.S. Pat. No. 3,173,879, to identify only a few of the actual plethora of patents that exist in this field.

A microencapsulation procedure which has been employed with good results in the practice of this invention, and is accordingly preferred, is that described in the Ruus U.S. Pat. No. 3,429,827, commonly assigned with this application, wherein the capsule walls are formed by means of an interfacial condensation polymerization reaction between polymerization reactants carried in the respective phases of a two liquid phase system. The dye precursor solution of the invention is dissolved in the dispersed phase liquid so as to be enclosed within the capsule walls ultimately produced around the dispersed phase globulea. A specific procedure under the Ruus patent which was used in producing precursor-containing microcapsules carried on transfer sheets utilized for making image markings for a considerable number of the experimental tests described above is described in the following preparation.

ENCAPSULATION PREPARATION

In 5 grams of the given solvent (e.g., xylene or dibutyl phthalate as mentioned previously) is dissolved one-half gram of trimesoyl chloride. 1.2 grams of terephthaloyl chloride is dissolved in 10 grams of the same solvent containing one-half gram of the selected color precursor compound and the two solutions are mixed. The resultant solution is then emulsified into 50 ml of water containing 0.5% polyvinyl alcohol after which a solution in 10 ml water of 0.9 grams diethylene triamine, 0.4 grams ethylene diamine and 0.7 grams sodium carbonate is added to the emulsion, mixing compatibly with the continuous phase. The emulsion is stirred at a slow speed for approximately 3 hours at about room temperature to allow the microcapsule wall-forming reaction reach substantial completion and the resultant microcapsules can then be separated from the continuous phase medium for further processing or the reaction solution containing the finished microcapsules can be used directly for coating the transfer sheet.

Where the microcapsules have some degree of adherence or can be treated in such a way as to acquire that state, they can be applied directly to the surface of the transfer medium and held thereon by their own adherence. In most instances, however, and this is true for the microcapsules obtained by the aforegoing "Preparation," it is necessary to provide a film-forming binder to hold the microcapsules in place on the transfer sheet surface. Any of the conventionally employed film-forming binders in this art are equally satisfactory here including polyvinyl alcohol, starch, and so on.

The point has already been made that the dye precursor compounds of the invention are dissolved in a selected solvent similar to virtually all of the prior art record materials using encapsulated image-forming reactants. The solvent here should be a substantially hydrophobic or non-polar organic solvent, preferably of relatively low volatility. In addition to the preferred solvents named above, use can be made of virtually any of an almost innumerable list of available liquids meeting these requirements. These include the natural oils such as caster oil, coconut oil, cotton seed oil, kerosene, petroleum lubricating fractions: synthetic oils such as silicone oil, dichloro diphenyl, chlorinated paraffin, etc; ester oils such as diethyl phosphate, dicresyl phosphate, ethyl and butyl acetate, etc; the aromatic solvents such as benzene, monochloro-benzene, n-cresol, etc; the chlorinated hydrocarbons such as methylene chloride, carbon tetrachloride, tetrachloroethane, etc., and so on. It is important that the selected solvent be free of any significant tendency to compete with the precursor in affinity for the clay, but in general this need will not be found a serious restriction on the wise choice of solvents useful in this invention.

In the precursor transfer media of the more common record systems previously available in the art, chlorinated diphenyl has been the overwhelming practical choice of precursor solvent because the clays of such systems, such as attapulgite and kaolin, were highly sensitive to deactivation by many other solvents. Such chlorinated solvents, however, are known to decompose on combustion to form phosgene and other dangerous by-products and the disposal of used record materials containing these solvents is becoming increasingly recognized as creating serious ecological hazards. One of the specialized features of this invention is the capability of using other solvents, e.g., dibutylphthalate, which appears to create no comparable disposal problem but could be tolerated in practical prior art systems.

The limits on the concentration of dye precursor in the solvent depend on pragmatic factors, mainly the high cost of this material. Sufficient precursor must be present to give on imaging the record material an initial image of useful visibility or intensity while the upper limit will reflect a balance of the added cost against the additional depth of image color given by larger amounts and the advantage of the added depth for the particular end use. A generally appropriate concentration range has been found to be about 1.5–5.0% by weight of the solvent in the precursor solution. Larger amounts can be added, if desired, but normally do not give sufficient benefit to justify the added cost.

Coating weights for the microcapsules will ordinarily be in the range of about 1.0–12 gm/sq.m. The microcapsules can be sized up to about 50 microns and about 1–20 microns is a preferred range.

Other additives for the precursor transfer medium are as a general rule not necessary and only rarely will the occasion arise where other ingredients would be desirable. However, there is no reason why any of the additives known to have value in the prior art systems could not serve equally well here, such as, for example, an ultraviolet absorber and the like.

APPLICATION OF CLAY COATING

The chemically modified smectite clays of the invention are extremely well adapted to ordinary coating techniques and procedures for applying conventional clay-containing coatings onto conventional record support material such as paper sheets or the like using standard coating equipment and when so applied give thin, uniform, even coatings or layers free of objectionable striations, channeling or other visible defects. For ordinary purposes, it is not necessary to resort to special measures or unusual conditions in order to obtain very satisfactory coatings containing the present clays. The range of coating weights that will be found suitable for the present record materials are from about 2.0 to 12.0 grams of clay per square meter of sheet surface to be coated, with 3.0–4.5 gm/sq.m. being preferred. In the ultimate sense, the minimum limit will be that amount of clay which is necessary to provide a substantially fully coated layer of at least a single thickness of clay particles while, at the opposite extreme, larger amounts of clay can be applied, but no unusual benefit or advantage will generally be obtained as a result thereof. The coating suspension or "color" can contain about 15–60% by weight of clay solids, preferably about 30–45%.

Any particle size of the clay in the normal range for paper-coating will be appropriate. The clays described throughout this description all passed through a 325 mesh screen.

The inclusion of some binder material to assist in retaining the clay on the record material surface is advantageous, and the selection of a proper binder for the record sheet is somewhat more critical than in the case of the transfer sheet, as it is important to avoid binders which tend to compete with the precursor compound for the affinity of the clay. Latices of synthetic polymers are particularly useful for this purpose, such as an acrylate or a vinylacetate polymer latex. Some of these polymers may tend to develop an off-color due to degradation on aging and should not be selected in those situations where stable coloration is an important prerequisite of the system. Continuous film-forming binders such as carboxymethyl cellulose, starch or the like can be tolerated only in small amounts and the presence of even these tend to produce some loss in the light fastness of the dye images obtained on sheets containing these materials. Fortunately, in most cases the dye images of this invention are sufficiently stable to tolerate these small losses.

In dispersing the clays of the invention to make coating compositions or for testing purposes, ammonia can be employed to good advantage without deliterious consequences on the ultimate effectiveness of the clay, since ammonia is evaporated from the record material shortly after the coating is applied. All of the viscosity tests summarized in FIGS. 1–4 were performed on dispersions of the various clays made alkaline with ammonia to pH 8–9. Apart from ammonia, significant amounts of dispersing assistants frequently employed in the paper-making art should be avoided, although a small amount of such dispersing agents as CMC and polyphosphate salts are permissible, say up to a few percent.

One clay coating formulation based on a mixture of a smectite clay of the invention and a kaolin clay can be prepared as in the following way:

Clay-Coating Formulation

| Parts by Dry Weight | Ingredient |
|---|---|
| 80.00 | Acid leached Bates Hole smectite clay |
| 20.00 | Astrobrite kaolin clay |
| 20.00 | Acrylic latex (PCX10 Union Carbide) 47% solids |
| 5.00 | CMC (Hercules 7L2) |
| 0.25 | Calgon hexametaphosphate |

The two clays are slurried for about 15 minutes with water in which the hexametaphosphate was previously dissolved. The pH of the mixture is then adjusted to 7.5 ± 0.2 with a dilute solution of ammonia admixed over 30 minutes. The CMC is now added as a 10% aqueous solution together with a sufficient quantity of the polymer latex (42.6 parts) to give 20 parts dry weight. Sufficient additional water is added to give a final total solids content of 35% and the entire formulation mixed for an additional 30 minutes. Storage should be under moderate agitation to prevent settling.

As mentioned early in this specification, the record materials of this invention can be of the type wherein both components of the color-developing system are situated on a common support rather than on separate supports of a manifold set. For example, the precursor containing microcapsules could be added directly to the clay makedown and applied to the support in a single coating operation. Alternatively, a microcapsule-containing layer can be coated first on the support after which the clay coating is applied. These techniques are well known in the art with respect to other record material systems and can be applied by the skilled worker to the present improvements without major difficulties.

It will be appreciated that coatings as such are not the only way for incorporating the clays of this invention onto the record material support. Other possibilities include impregnating the pores of a previously formed paper with a wash of a clay suspension or adding the clay directly to the furnish for making the paper.

Throughout the course of the aforegoing description, an effort has been made to identify useful options and alternatives in the particular context to which they relate. However, this has not been done on an exhaustive basis and, obviously, other alternatives, variations and modifications may occur to the skilled worker in this art as a result of the above detailed description. Consequently, the scope of the present invention should not be construed as limited to the details of the various embodiments which have been presented for purposes of illustration and not of defining the limits of the invention. Rather, the delineation of the invention novelty appears in the appended claims.

What is claimed is:

1. Record material for forming a colored image of improved resistance to fading on imagewise contact with an image-forming material consisting essentially of an electron-donating colorless dye precursor compound, comprising a support carrying a uniform even distribution throughout a recording area thereof of a multitude of finely divided particles of a clay consisting essentially of at least about 15% by weight of montmorillonite clay mineral having an expanding three-layer lattice molecular structure exhibiting when analyzed in the presence of benzyl ether of Michler's hydrol by X-ray diffraction at least a discernible peak at a 2 $\theta$ value of 5.6–5.7, a sufficient proportion of said molecular structure having been irreversibly chemically altered to impart substantially Newtonian viscosity behavior to an aqueous suspension containing at least about 15% by weight of said clay particles.

2. Record material as in claim 1 wherein said clay contains up to about 80% of a non-montmorillonite clay.

3. Record material as in claim 1 wherein said montmorillonite clay molecular structure is irreversibly altered by treatment of the clay with an acid followed by substantial removal of said acid and acid salts from the clay.

4. Record material as in claim 3 wherein said acid treatment is sufficient to increase the hydrated silica value and decrease the alumina content of the clay by at least about 2–3% by weight relative to the untreated clay.

5. Record material as in claim 3 wherein said clay has an acidity equivalent to not more than about 1.5 mg/KOH per 5 gms clay.

6. Record material as in claim 1 wherein said clay is present on said support as a thin uniform layer of said clay particles having a weight of about 2–12 gm/sq.m.

7. A pressure sensitive record system having improved resistance to fading comprising a manifold set of at least one transfer sheet and at least one receiving sheet, said transfer sheet carrying on at least a portion of the surface thereof in an insulated pressure-releasable state a solution of image-forming material consisting essentially of an electron-donating organic dye precursor adapted to produce color on contact with an electron-acceptor solid, and said receiving sheet carrying on at least a corresponding8c area of an adjacent surface a uniform even distribution of a multitude of finely divided particles of a clay consisting essentially of at least about 15% by weight of montmorillonite clay mineral having an expanding three-layer lattice molecular structure exhibiting when analyzed in the presence of benzyl ether of Michler's hydrol by X-ray diffraction at least a discernible peak at a 2 $\theta$ value of 5.6–5.7, a sufficient proportion of said molecular structure having been irreversibly chemically altered to impart substantially Newtonian viscosity behavior to an aqueous suspension containing at least about 15% by weight of said clay particles.

8. The record system of claim 7 wherein said dye precursor solution is contained in microcapsules forming a layer on said transfer sheet.

9. The record system of claim 8 wherein said microcapsule layer is applied at a weight of about 1–12 gms/sq.m.

10. The record system of claim 7 wherein said dye precursor is dissolved in an oily solvent of low volatility.

11. The record system of claim 10 wherein said oily solvent has a boiling point of at least about 200°C.

12. The record system of claim 7 wherein said montmorillonite clay is chemically altered by treatment with an acid and has a residual acidity equivalent to not more than about 1.5 mg/KOH per 5 gms clay.

13. The record system of claim 7 wherein said receiving sheet has on the surface thereof a thin uniform even layer of clay particles having a weight of about 2–12 gm/sq.m.

14. The record system of claim 7 wherein said precursor is present in said solution in a concentration of about 1.5–5% by weight.

15. A pressure-sensitive self-contained image-producing record material having improved resistance to fading comprising a sheet support having on one side thereof finely divided liquid inclusions of a solution of an organic dye precursor maintained in an isolated pressure-releasable condition, said precursor consisting essentially of an electron-donating compound adapted to produce color on contact with an electron-acceptor solid, and on the same side of said support a uniform even distribution of a multitude of finely divided particles of a clay consisting essentially of at least about 15% by weight of montmorillonite clay mineral having an expanding three-layer lattice molecular structure exhibiting when analyzed in the presence of benzyl ether of Michler's hydrol by X-ray diffraction at least a discernible peak at a 2 $\theta$ value of 5.6–5.7, a sufficient proportion of said molecular structure having been irreversibly chemically altered to impart substantially Newtonian viscosity behavior to an aqueous suspension containing at least about 15% by weight of said clay particles.

16. The record material of claim 15 wherein said liquid incursions of said precursor solution are contained within microcapsules.

17. The record material of claim 15 wherein said precursor is present in said solution in a concentration of about 1.5–5% by weight.

18. The method of making a record material useful for producing images having improved resistance to fading on contact with an organic electron-donating dye precursor compound reactive to produce color with an electron-acceptor solid comprising the steps of:

1. Contacting a clay consisting essentially of at least about 15% by weight of montmorillonite clay mineral having an expanding three-layer lattice molecular structure with an aqueous solution of an acid effective to alter the molecular structure of said clay for a time of at least about one hour but less than the time required to so alter the molecular structure of said clay that on examination by X-ray diffraction in the presence of benzyl ether of Michler's hydrol no discernible peak appears at a 2 $\theta$ value of about 5.6–5.7,
2. Dispersing said acid-treating clay in an aqueous medium to give a concentration therein of said acid-treated clay at least about 10% by weight,
3. Applying said clay dispersion to a supporting web or sheet to give a uniform even distribution of clay particles at one surface of said web or sheet, and 4. Drying the resultant web or sheet.

19. The method of claim 18 wherein said clay dispersion is coated as a thin uniform even layer on said web or sheet surface.

20. The method of claim 19 wherein said clay dispersion has a concentration of clay solids of about 30–45% by weight.

21. The method of claim 20 wherein all of said clay solids is constituted by acid-treated montmorillonite clay.

22. The method of claim 18 wherein said clay is dispersed in said aqueous medium in the absence of significant amounts of non-volatile dispersing agents.

23. The method of claim 18 wherein said acid-treating clay is mixed with a non-montmorillonite clay in proportions of montmorillonite to non-montmorillonite clay of up to 1:4 by weight before being applied to said web or sheet.

24. The method of claim 18 wherein, prior to dispersing said clay, the acid and acid by-products are substantially removed therefrom.

25. A method of forming a colored image of improved resistance to fading on a record material comprising a support carrying a uniform even distribution throughout a recording area thereof of a multitude of finely divided particles of a clay consisting essentially of at least about 15% by weight of montmorillonite clay mineral having an expanding three-layer lattice molecular structure exhibiting when analyzed in the presence of benzyl ether of Michler's hydrol by X-ray diffraction at least a discernible peak at a 2 $\theta$ value of 5.6–5.7, a sufficient proportion of said molecular structure having been irreversibly chemically altered to impart substantially Newtonian viscosity behavior to an aqueous suspension containing at least about 15% by weight of said clay particles, which comprises the step of imagewise contacting said material with an image-forming solution consisting essentially of an electron-donating colorless dye precursor compound.

26. The method of claim 25 wherein said colorless dye precursor compound is of a diphenyl- or triphenylmethane dye.

* * * * *